US007686138B2

(12) United States Patent
Schmidt

(10) Patent No.: US 7,686,138 B2
(45) Date of Patent: Mar. 30, 2010

(54) FREE STANDING STEP WITH USER CUSTOMIZABLE HEIGHT AND FLAT EXPANDING DECK

(76) Inventor: Helene Schmidt, 2 DeVille Ct., Newark, DE (US) 19711

( * ) Notice: Subject to any disclaimer, the term of this patent is extended or adjusted under 35 U.S.C. 154(b) by 0 days.

(21) Appl. No.: 12/106,293

(22) Filed: Apr. 19, 2008

(65) Prior Publication Data

US 2008/0257650 A1 Oct. 23, 2008

Related U.S. Application Data

(60) Provisional application No. 60/925,389, filed on Apr. 19, 2007.

(51) Int. Cl.
*E04F 11/02* (2006.01)

(52) U.S. Cl. ..... 187/201; 52/184

(58) Field of Classification Search ..... 187/201; 52/184

See application file for complete search history.

(56) References Cited

U.S. PATENT DOCUMENTS

| | | | | | |
|---|---|---|---|---|---|
| D287,283 | S | * | 12/1986 | Johnson | D25/69 |
| 5,355,904 | A | * | 10/1994 | Wallum | 135/65 |
| 5,664,379 | A | * | 9/1997 | Kroll et al. | 52/184 |
| 5,924,249 | A | * | 7/1999 | Kroll et al. | 52/184 |
| 7,131,522 | B2 | * | 11/2006 | Sircovich | 198/322 |

* cited by examiner

*Primary Examiner*—Thomas J. Brahan
(74) *Attorney, Agent, or Firm*—Michael Ries

(57) ABSTRACT

Disclosed in the present invention is a step assembly that facilitates stair climbing. This can aid a person with leg or back pain, decreased range of motion or limited physical strength, due to handicap, injury or infirmity. This free standing, user customizable height step with flat expanding deck surface. The disclosed present invention is a significant improvement over previous attempts to assist individuals by creating a fully adjustable and flat tread surface for the user. The present invention step also provides user customizable heights, by adding adjustment layers, so that the present invention can be used in a variety of step heights.

20 Claims, 30 Drawing Sheets

28

33

33

33

33

36

36

38

380

FREE STANDING STEP WITH USER CUSTOMIZABLE HEIGHT AND FLAT EXPANDING DECK

This application claims priority to U.S. Provisional Application No. 60/925,389 filed Apr. 19, 2007, the entire disclosure of which is incorporated by reference.

TECHNICAL FIELD AND BACKGROUND

The present invention relates to a free standing step with customizable height and a flat expanding deck that may be installed permanently or just temporarily assisting individuals with stair climbing.

Several prior inventions have attempted to aid an injured or infirm person in climbing stairs. However, all previous devices have limitations. The Step has addressed and eliminated all these drawbacks. Previous patents do not have a flat surface since they are based on a box within a box design. U.S. patents:

U.S. Pat. No. 5,924,249 William P. Kroll et.al. Jul. 20, 1999

U.S. Pat. No. 5,664,379 William P. Kroll et.al Sep. 9, 1997

U.S. Pat. No. 5,355,904 Ronald I. Wallum Oct. 18, 1994

Previous patents require a predetermined height at the time of manufacture of their devices U.S. Patents:

U.S. Pat. No. 5,924,249 William P. Kroll et.al. Jul. 20, 1999

U.S. Pat. No. 5,664,379 William P. Kroll et.al Sep. 9, 1997

U.S. Pat. No. 5,355,904 Ronald I. Wallum Oct. 18, 1994

Des 287,283 Paul R. Johnson Dec. 16, 1986

Previous devices require the devices to be either mounted on a rail attached to the side of the staircase or a series of connecting members requiring many steps to provide stability U.S. patents:

U.S. Pat. No. 5,924,249 William P. Kroll et.al. Jul. 20, 1999

U.S. Pat. No. 5,664,379 William P. Kroll et.al Sep. 9, 1997.

The present invention step assembly facilitates stair climbing. This can aid a person with leg or back pain, decreased range of motion or limited physical strength, due to handicap, injury or infirmity. This free standing, user customizable height step with flat expanding deck surface, will hereafter be referred to as "The Step".

The Step is a significant improvement over previous attempts to assist individuals by creating a fully adjustable and flat tread surface for the user. The Step also provides user customizable heights, by adding adjustment layers, so that The Step can be used in a variety of step heights. If desired, other fractional height configurations can be created. Such configurations can be, but are not limited to ⅓ and ⅔ steps heights. These may be used on particularly tall steps. This is easily accomplished by simply selecting the appropriate adjustment layers for each desired height.

The design of The Step permits it to be used on one step, as in the case of a sunken living area or a number of them can be installed on an entire flight of stairs. The stability of The Step is produced by unique adjustable vertical members that use the bottom of the existing step in the house or building and/or adhesive products. Carpet gripping surfaces are built in and can be deployed by inverting the bottom plate during the height adjustment assembly process. Conversely, the other side of the bottom plate is suitable for use on uncarpeted stairs. In addition one side of The Step can be adjusted to allow the installation of The Step on stairs that have a carpet runner only on the center part of the stairs. The Step may be installed permanently by screwing the step to the stairs if desired. Pocket screw holes in the frame and slots in the base, gripping plate and adjustment layers can facilitate this installation.

The step can be manufactured in any width, for example twice as wide, to accommodate persons desiring to place both feet on the step to steady themselves or rest temporarily, prior to taking the step to the next level.

BRIEF DESCRIPTION OF THE DRAWINGS

The objects, features, and advantages of the present invention will be apparent from the following detailed description of the preferred embodiment of the invention with references to the following drawings.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
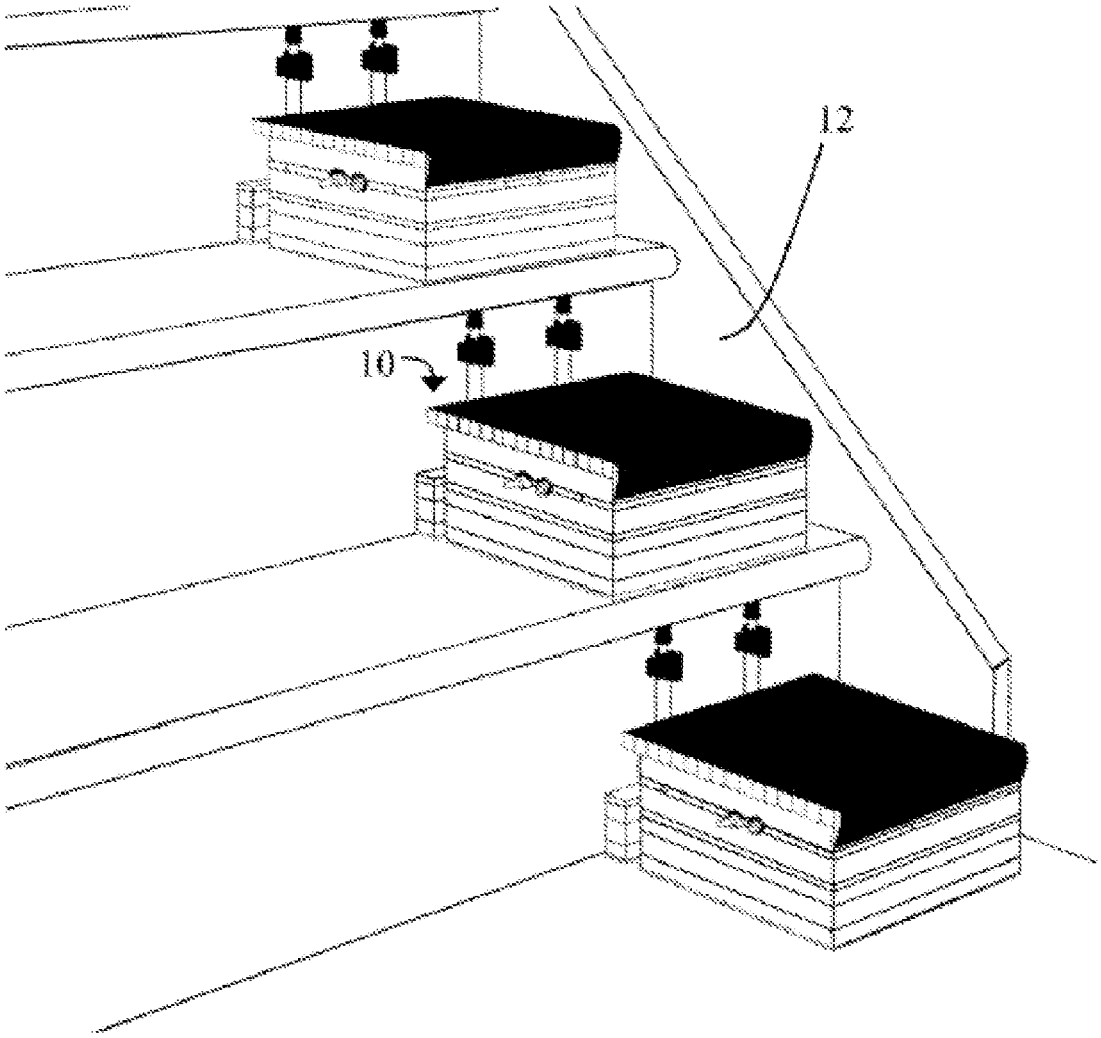
FIG. 1*a* is a perspective view of the step in accordance with the present invention.

Now referring to FIG. 1*a* as in one embodiment shown is a step 10 in a installed in a typical stair case 12.

Materials

The Step 10 may be made out of wood, metal, plastic, ceramic, engineered composites or any other suitable material that offers the physical, chemical and mechanical properties required for this device.

Construction

The method of construction will be described for The Step 10 made out of wood. The choice of woodworking joints used in the example should not preclude the use of other woodworking techniques. For example if a miter joint is shown, it does not preclude the use of other wood joining techniques. Other materials may offer or require different fabrication and/or assembly methods. Different widths will require wider center supports. For the purpose of illustrating the invention, an 8 inch wide step will be described in the remainder of this document unless otherwise noted. The invention consists of these distinct parts:

- Deck
  - Frame
  - Center Support
  - Sliders
  - Base
  - Gripping Plate
  - Slider Base
  - Slider Gripping Plate
  - Adjustable vertical brace
  - Adjustable Height Assembly for The Step
  - Adjustable Height Assembly for Sliders
  - Surface Covering

Deck

Figure 1B:
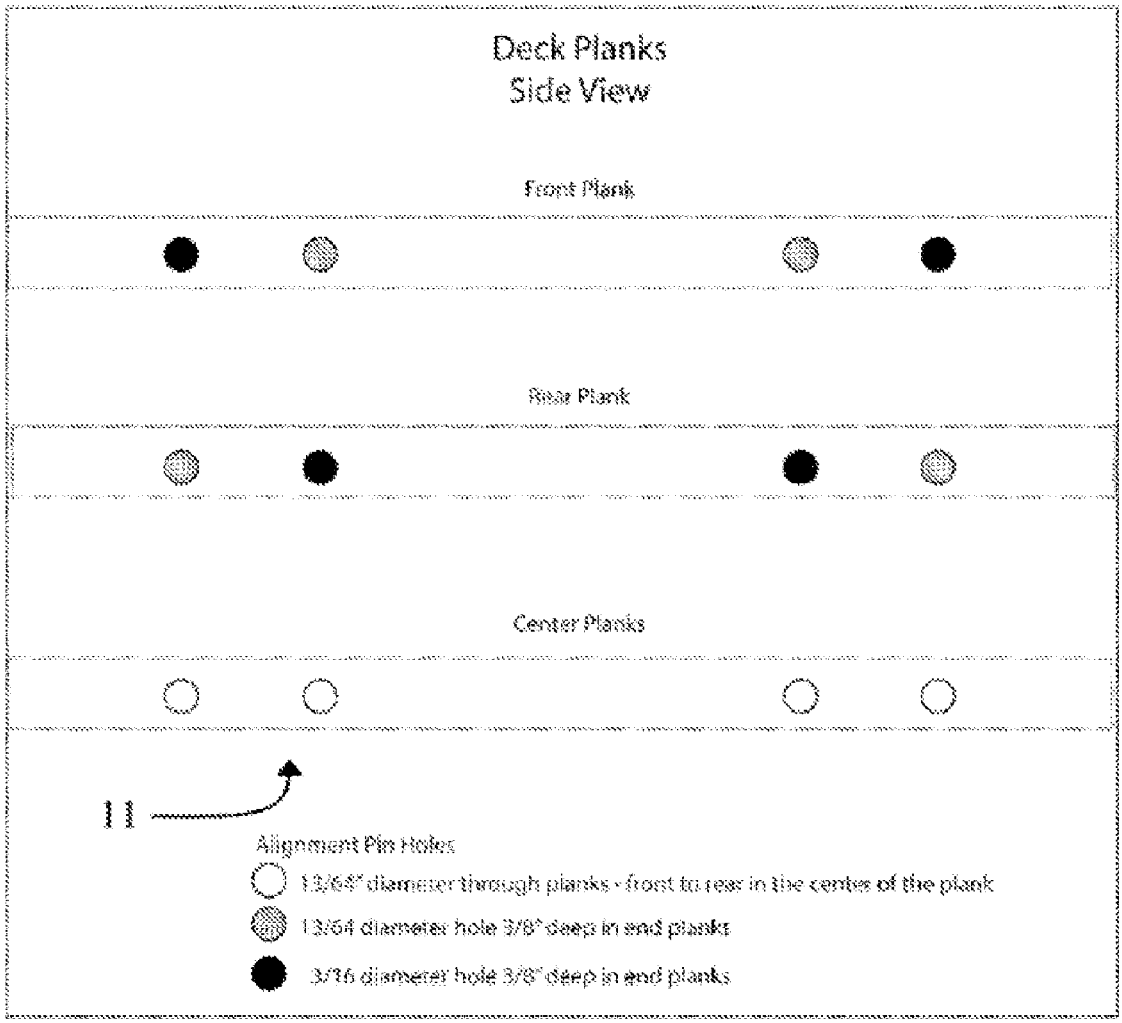
FIG. 1*b* is a side-view of Deck Planks in accordance with the present invention.

The Deck consists of a number of individual planks, alignment pins, set screws, mounting screws and travel limiting mechanisms. Shown in FIG. 1*b* is a side view of deck planks 11.

Deck Materials

The planks can be made of wood, metal, plastic, ceramic, engineered composites or any other material that offers the properties required for this function. The prototype's planks were oak ½"×½" by 8". The front and rear planks have alignment pins attached to them so that the step will open and close on the same plane of travel. Two alignment pins are attached to the front plank and two are attached to the rear plank. The four alignment holes for the alignment pins must be drilled through each plank parallel to the top surface of the deck and perpendicular to the front of The Step. For esthetic reasons the holes drilled in the front and rear planks do not extend through the planks See FIGS. 1*a* and 1*b*.

Figure 2:
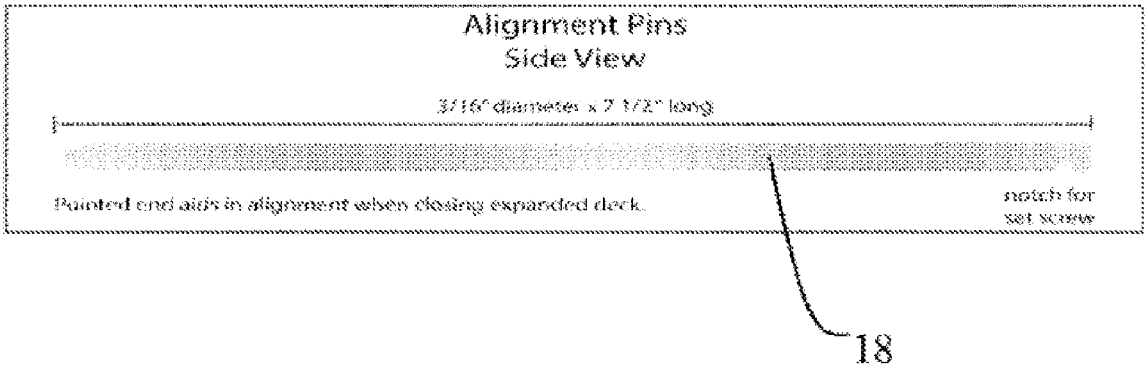
FIG. 2 is a side-view of Alignment Pins in accordance with the present invention.
Figure 3:
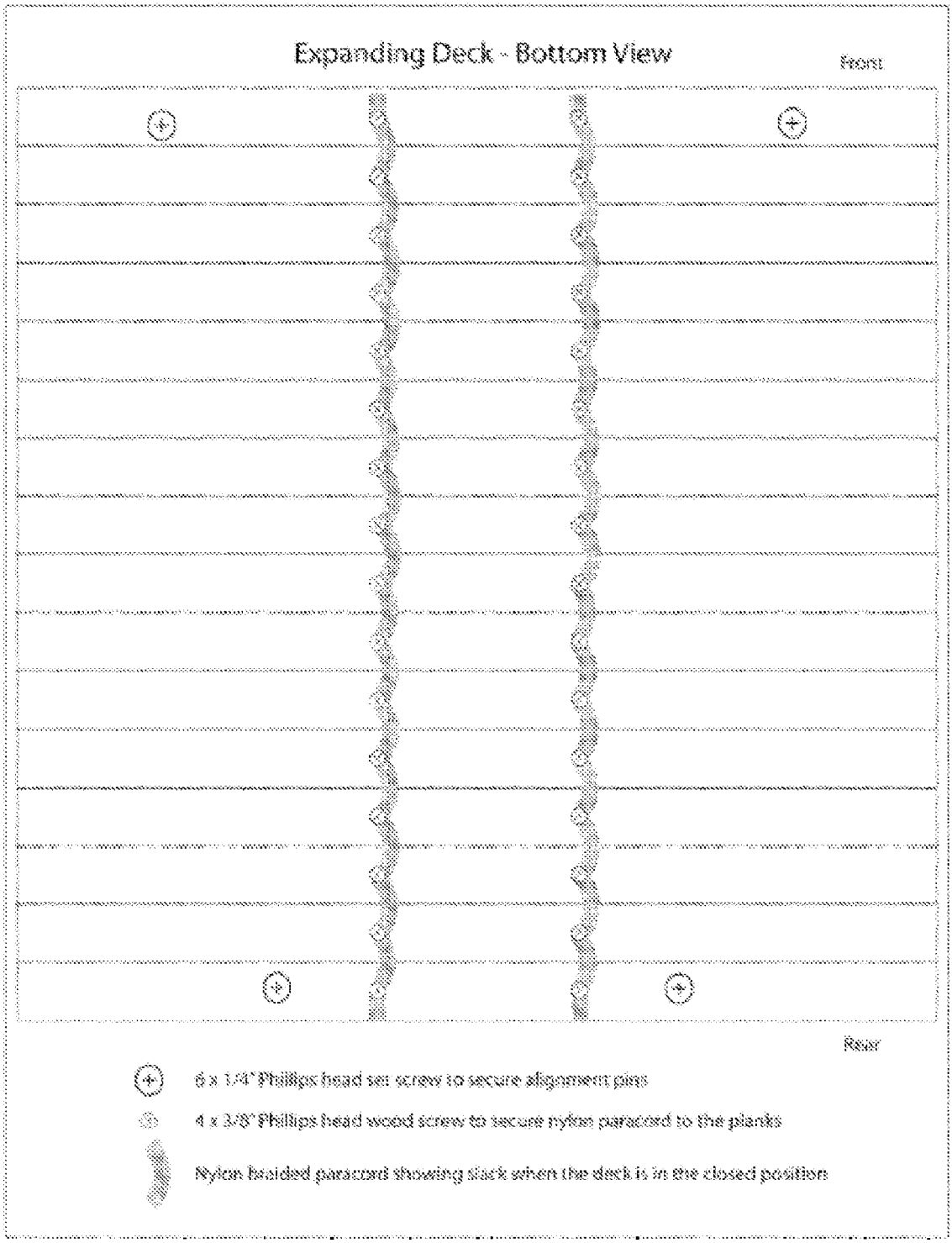
FIG. 3 is a bottom-view of an Expanding Deck in accordance with the present invention.

The alignment pins can be made of wood, metal, plastic, ceramic, composite or any other material that offers the properties required for this function. In my prototype, the alignment pins were zinc coated 3/16"×7½" aluminum rods. One end was pointed to allow easy alignment of the planks when the step is being closed. The other end has a flat notch, perpendicular to the length of the rod, which allows set screws to secure the rods to the end planks on the bottom side of the planks See FIG. 2 The set screws were 6×⅜" wood screws with the point removed to provide a flat surface to match the flat notch in the alignment pin. The set screw head was not countersunk, to allow sufficient strength in the remaining plank material. Instead, material was removed in the frame and sliders to allow the deck to rest evenly on the frame and slider surfaces. See FIG. 3.

Figure 4:
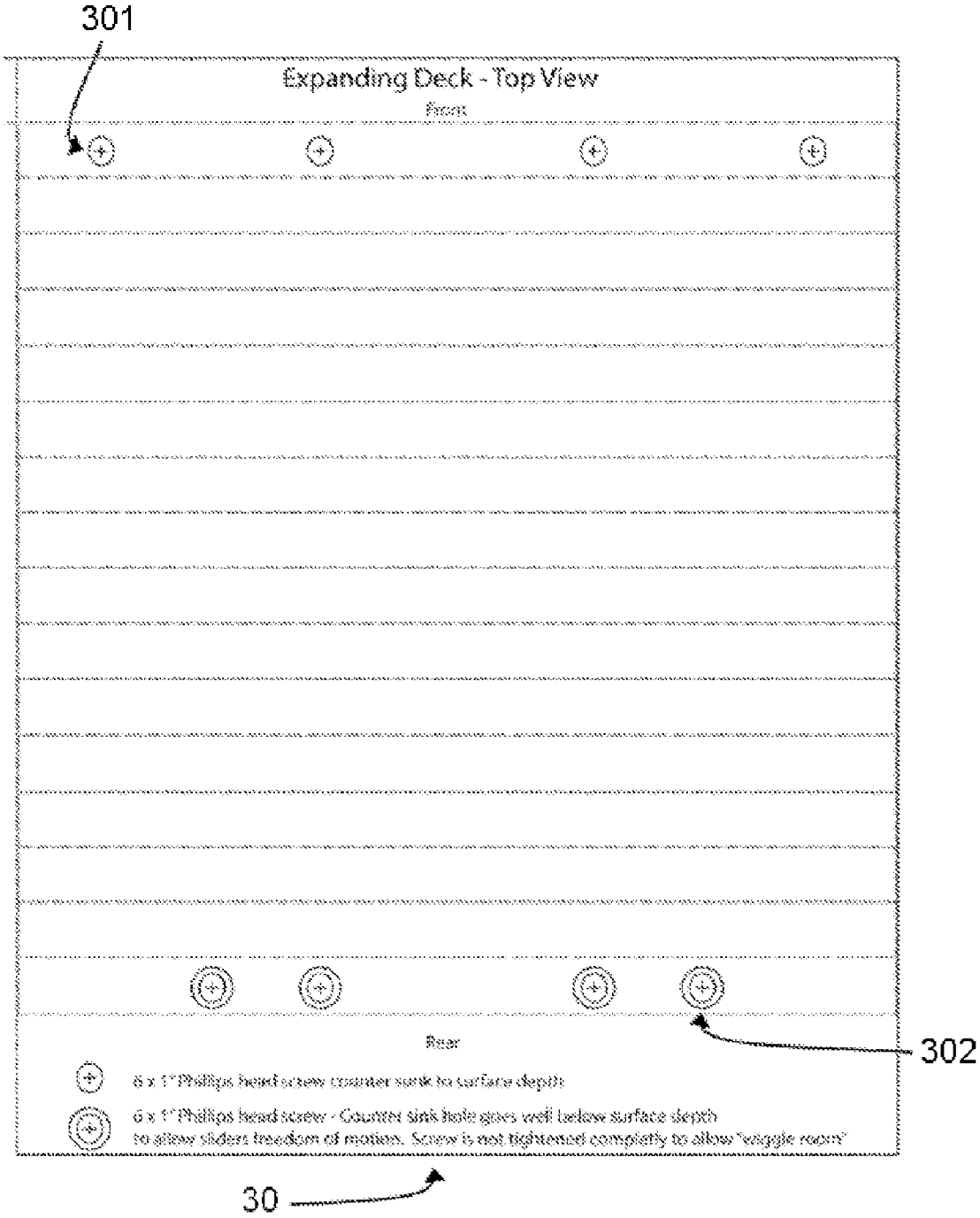
FIG. 4 is a top-view of an Expanding Deck in accordance with the present invention.
Figure 5:
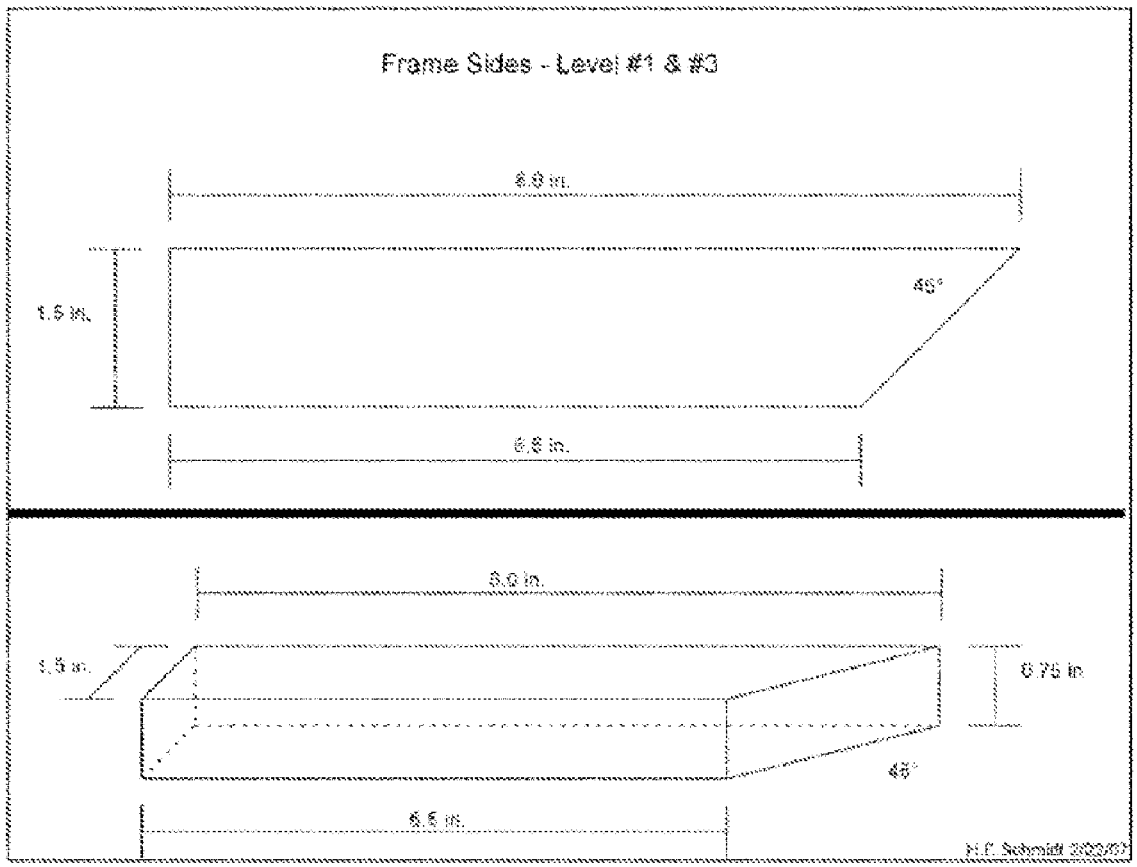
FIG. 5 is a view of Frame Sides—Levels #1 & #3 in accordance with the present invention.
Figure 6:
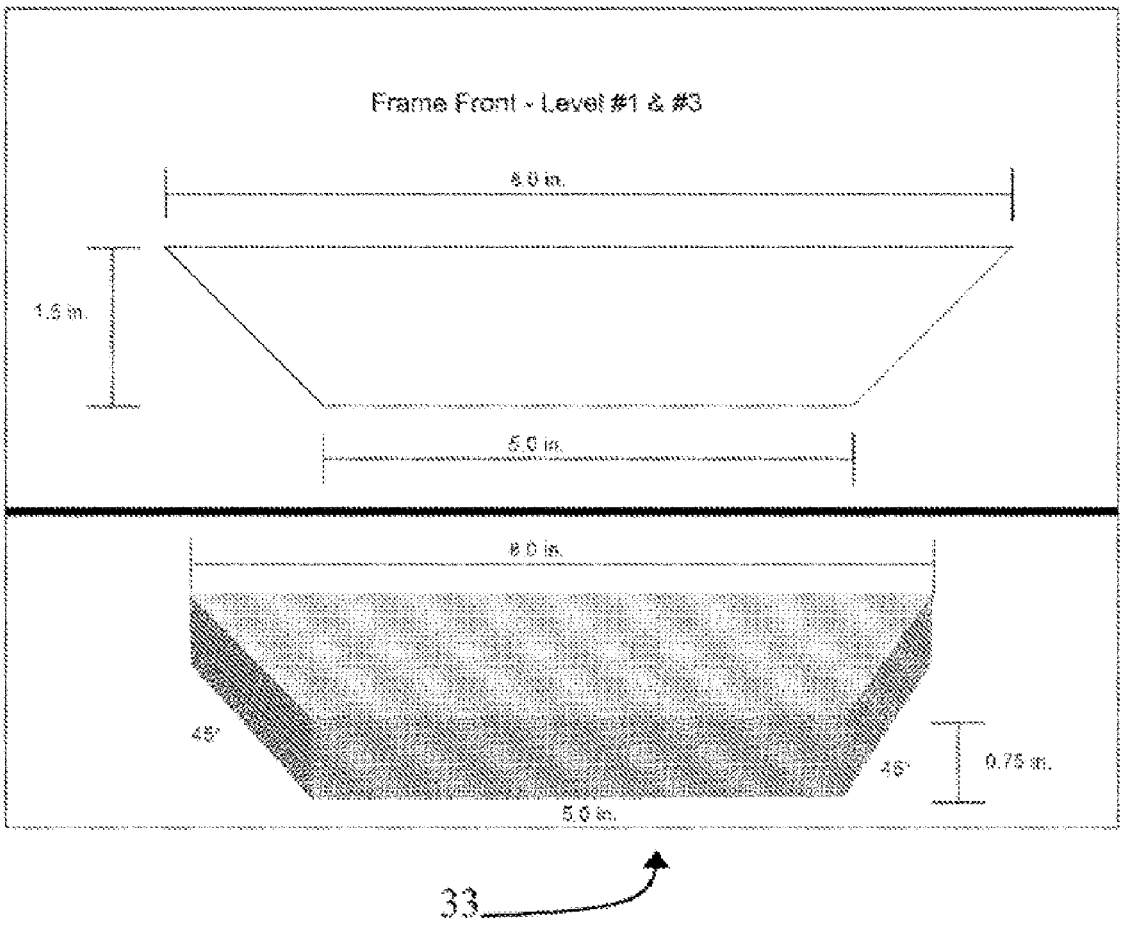
FIG. 6 is a view of a Frame Front—Levels #1 & #3 in accordance with the present invention.
Figure 7:
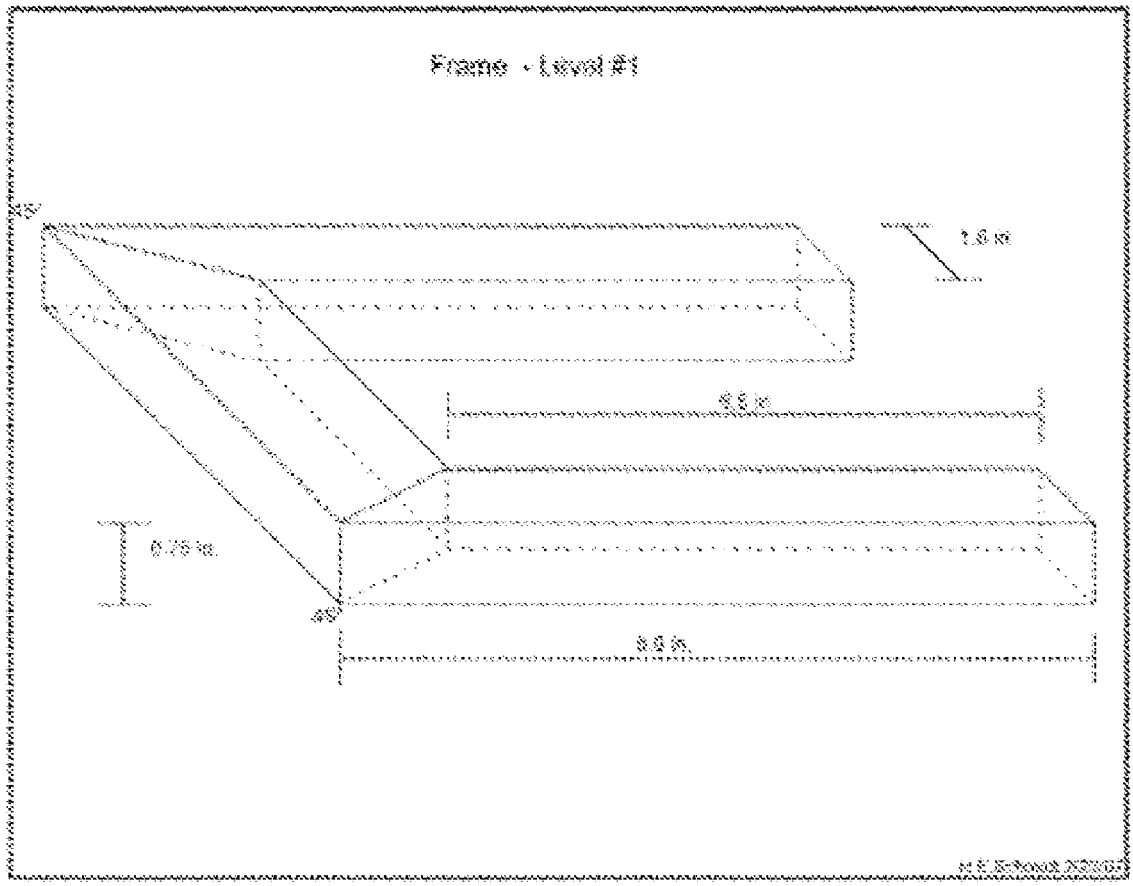
FIG. 7 is a view of Frame Level #1 in accordance with the present invention.
Figure 8:
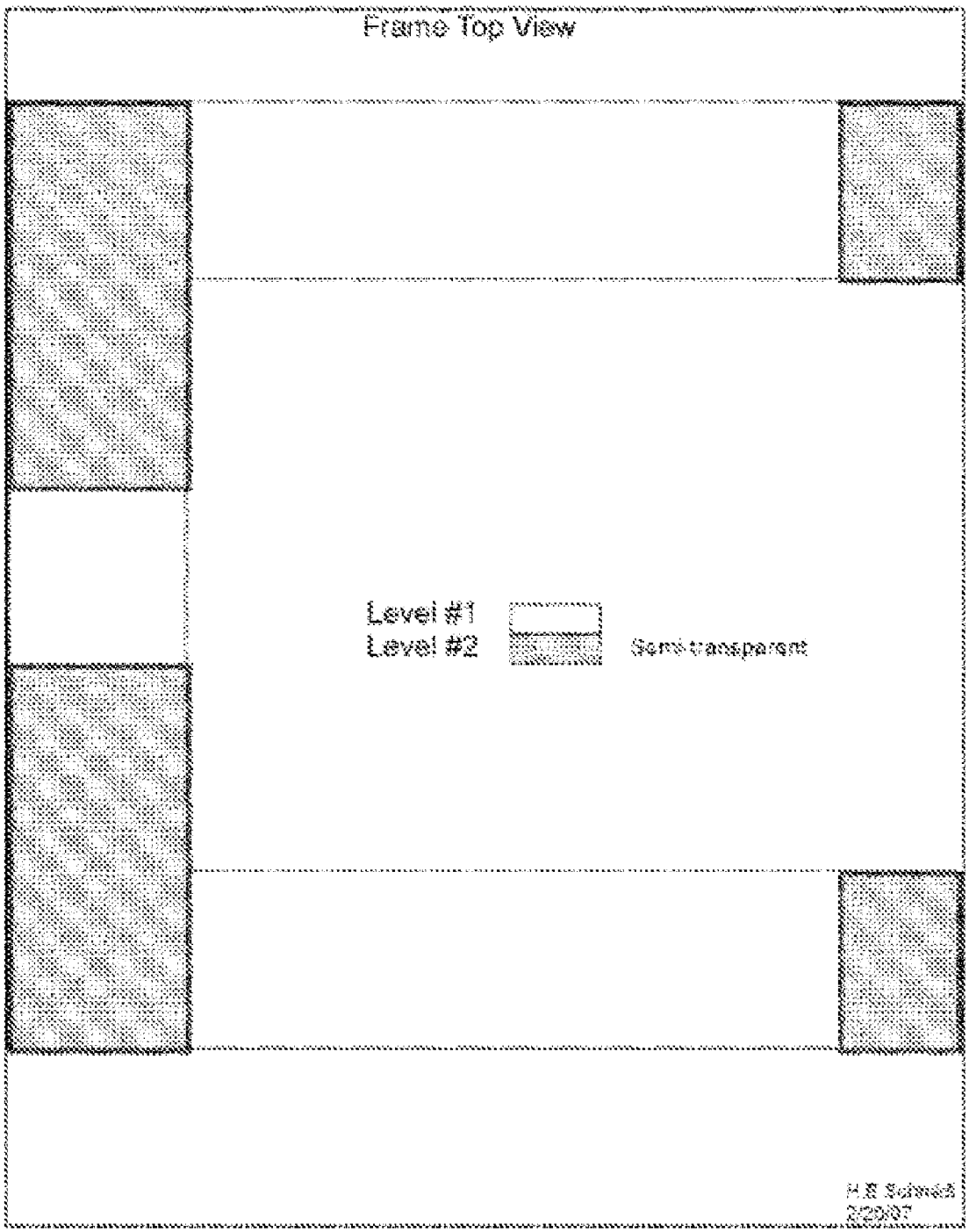
FIG. 8 is a view of a Frame Top in accordance with the present invention.
Figure 9:
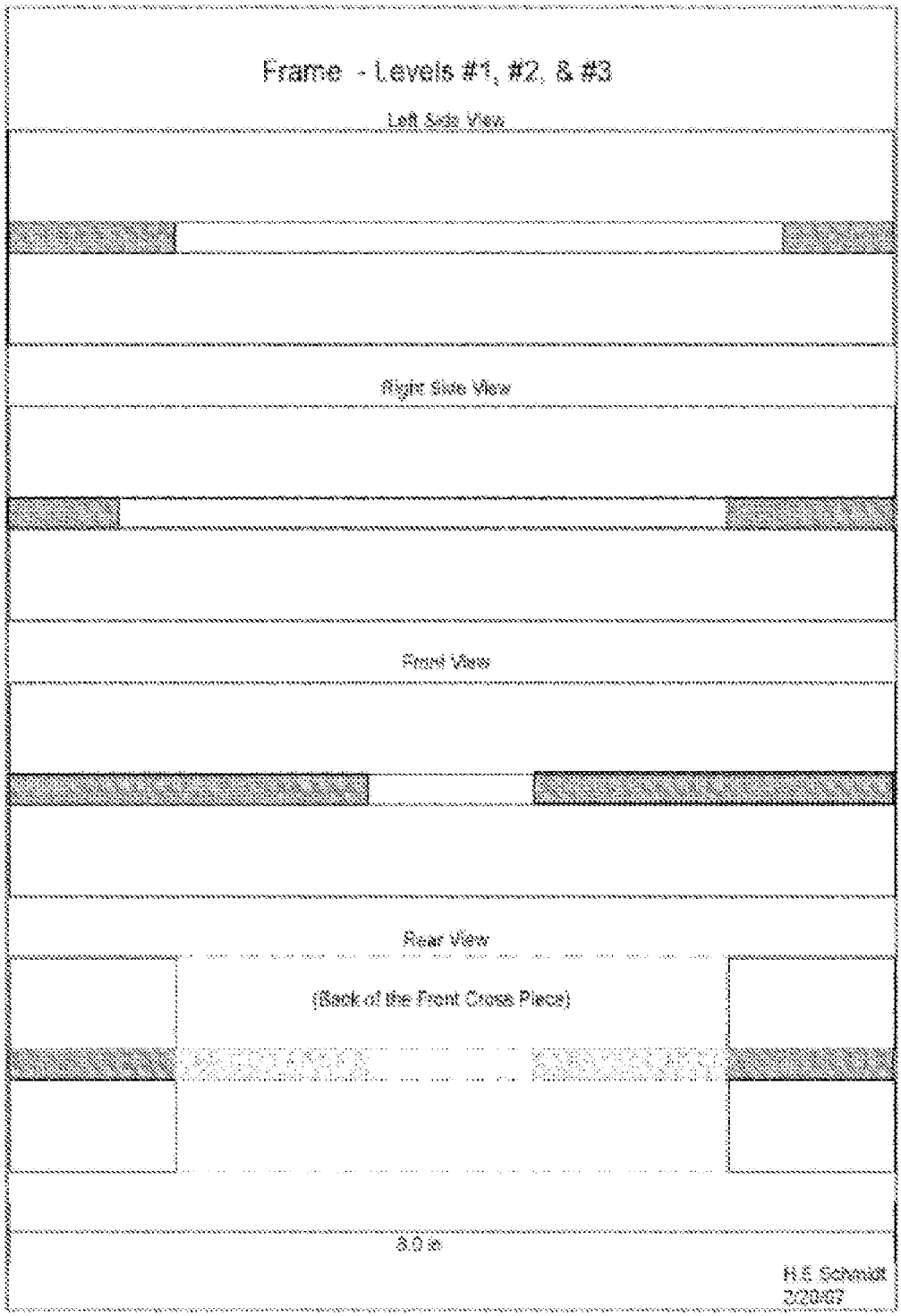
FIG. 9 is a view of a Frame—Levels #1, #2 & #3 in accordance with the present invention.

The front end plank is attached to the front of the frame at attachment points 301 while the rear plank is attached to the sliders with mounting screws at attachment point 302. The end planks were attached with 1" flat head Phillips wood screws that were countersunk into the planks The rear plank had larger holes through the plank and larger counter-sunk holes to permit some slight movement that may be necessary to allow the sliders to operate freely. See FIG. 4.

The planks are attached to each other in a manner that allows a limited range of travel apart from each adjacent plank. The means of limiting the travel can vary considerably depending on the method of manufacture. If the mechanism is located on the bottom of the planks the mechanism shall be located in the area that aligns with the gap between the Center Support and the Sliders. In addition, grooves or channels shall be made on the top surface of the front frame member to allow for the free working of the mechanism. If the mechanism uses the front and rear faces of the planks, the grooves in the frame and specific location of the mechanism is not necessary. See FIG. 3.

Any device that is fixed to one plank and, when moved in a linear direction along the Alignment Pins, causes the next plank to move in the same linear direction along the alignment pins can be used as the travel limiting mechanism. This mechanism may be made out of wood, metal, plastic, natural or man made fibers, ceramic or composite materials. The specific method I chose in my prototype was limited by available materials and my woodworking skills. However, the materials or manufacture of the deck may permit the mechanism to be built into or added to the sides or bottom surface of the planks. If built into the sides of the planks, there would be no need to create grooves in the frame or provide ample room between the sliders and the center support. For example an "L" or hook shaped object could be used to pull against a fixed post or staple or second "L" or hook shaped object on the adjacent member causing it to move when force is applied in the direction of travel. A similar mechanism with something like a link of chain could be attached to each plank with something like a staple or "U" shaped nail so that the link would be free to slide along the staple or "U" nail and then pull against the adjacent plank when the limit is reached. The possibilities are numerous and the ones listed here do not define the scope of this invention.

The planks in the prototype were attached by a braided ⅛" nylon paracord that was screwed into the bottom of each plank with 4×⅜" wood screws. See FIG. 3.

Deck Fabrication and Assembly

The 8" deck planks are cut from ½"×½" square hardwood. Care should be used in selecting the material to make sure the wood is not warped or twisted. The prototype used oak which had minor variations that appeared during the construction process. Fabrication in other materials should not be subject to the dimensional distortions found in wood.

The front and back planks were identified and labeled since they require specific treatment to secure the alignment pins and to fasten the entire deck to the frame and sliders.

A jig was constructed to allow a drill press to drill 13⁄64" diameter holes in each plank in precisely the same locations so that the alignment rods could easily pass through the holes. The bottom of each plank was marked to indicate how each plank was oriented during the drilling operation, so that this orientation could be maintained for the assembly of the deck. The front plank had 13⁄64" diameter holes drilled where the alignment pins attached to the rear plank entered the front plank. The rear plank had 13⁄64" diameter holes drilled where the alignment pins attached to the front plank entered the rear plank.

Using the same jig, 3⁄16" diameter holes were drilled ⅜" deep in the front and rear planks for the alignment pins so they can be attached securely to those planks. See FIGS. 1*a* and 1*b*.

On the bottom of the front and rear planks, holes for the set screws were drilled perpendicular to and extending into the 3⁄16" holes.

The alignment pins were cut from a length of smooth zinc coated 3⁄16" aluminum rod stock. One end of the pin was filed to a rounded point with a Dremmel tool and the other end had a notch about 3⁄16" long and 1⁄16" deep filed into the rod about 1⁄16" from the end of the pin. The alignment pins were inserted into the alignment holes on the front and rear planks with the notch facing the set screws. The alignment pins are then and secured with the set screws to prevent the alignment pins from pulling out of the front and rear planks when the deck is expanded. Set screws were made from 6×⅜" Pan Phillips zinc metal screws that had the points cut off with a Dremmel tool to provide a flat end to the screw that will contact the flat notch in the alignment pin. See FIG. 2.

A silicone lubricant (Gunk Liquid Wrench Heavy Duty Silicone Spray from Radiator Specialty Co. www.gunk.com) was applied with a cloth to the alignment pins and the remaining planks were inserted on the front alignment pins making sure the original orientation determined during the drilling step was maintained. Candle wax may also be a useful lubricant for this mechanism made out of wood and metal. After orienting the rear plank correctly, the alignment pins were inserted into the stack of planks. If any resistance to the opening and closing of the expanding deck is noted, the alignment pins may need additional filing to make sure the point of the alignment pin is in line with the alignment holes.

Travel Limiting Mechanism Materials

Any device that is fixed to one plank and, when moved in a linear direction along the Alignment Pins, causes the next plank to move in the same linear direction along the alignment pins can be used as the travel limiting mechanism. This mechanism may be made out of wood, metal, plastic, natural or man made fibers, ceramic or composite materials. The specific method I chose in my prototype was limited by available materials and my woodworking skills. However, the materials or manufacture of the deck may permit the mechanism to be built into or added to the sides or bottom surface of the planks. If built into the sides of the planks, there would be no need to create grooves in the frame or provide ample room between the sliders and the center support. For example an "L" or hook shaped object could be used to pull against a fixed post or staple or second "L" or hook shaped object on the adjacent member causing it to move when force is applied in the direction of travel. A similar mechanism with something like a link of chain could be attached to each plank with something like a staple or "U" shaped nail so that the link would be free to slide along the staple or "U" nail and then pull against the adjacent plank when the limit is reached. The possibilities are numerous and the ones listed here do not define the scope of this invention.

The planks in the prototype were attached by a braided ⅛" nylon paracord that was screwed into the bottom of each plank with 4×⅜" wood screws. See FIG. 3.

Travel Limiting Mechanism Fabrication and Assembly

With the deck in the closed position, and the bottom of the planks facing up, draw a line 3⅛" from each side of the deck. This is the guide line for the travel limiting mechanism. The travel limiting mechanism used in the prototype is a nylon woven paracord screwed to the back of each plank. To use this mechanism, remove the planks from deck assembly and drill 1⁄32" diameter pilot holes about ⅛" deep on each guide line in the middle of the back of the each plank on the guide line. Reassemble the deck, maintaining proper orientation of all the planks Place temporary 3⁄16" spacers between each plank and clamp the planks and spacers together. Then, using a pointed object like a dental tool or marlin spike, like a sailor might use when working with lines, or any other suitable pointed object, create a gap in the center of the width of the paracord where the screw will be placed. I used a plastic disposable flossing tool with a pointed end (made by John O. Butler Co., Chicago, Ill.). Place a screw in the hole and insert the point into the pilot hole in the front plank. Screw the screw into the bottom of plank. Stretch the cord over the guide line and make another hole with the marlin spike for the next screw hole.

Experience has shown the hole in the paracord should be started on the far side of the pilot hole. Secure the screw and paracord in place. Continue securing the nylon paracord to the planks along the guide line until all planks are attached. Repeat the process on the other guide line. When all the planks have been attached, the two travel limiting mechanisms are complete and the clamps and temporary spacers can be removed. The deck is now complete except for the mounting holes to the frame and sliders.

The front end plank is securely attached to the front of the frame at attachment points 301 while the rear plank is attached to the sliders with mounting screws at attachment points 302. Drill a 5/32" diameter hole and a small countersink hole just large enough for the screw head for the front mounting screws in the locations shown in FIG. 4. The rear plank had 3/16" holes through the plank and larger counter-sink holes to permit some slight movement that may be necessary to allow the sliders to operate freely. The end planks were attached to the frame with 1" flat head Phillips wood screws that were countersunk into the planks. See FIG. 4.

Frame

The frame can be made of wood, metal, plastic, ceramic, engineered composites or any other material that offers the properties required for this function. The frame in the prototype consists of three levels. If the step is made out of other materials, several or all of these levels may be combined. The bottom layer is level 1, the middle layer is level 2 and the top layer is level 3.

Frame Materials

The prototype's frame used 1½"×¾" oak and 1½"×¼" pine. If 1½"×⅜" material was available, that would have been a better choice since during the glue up process the ¼" pine decreased in size and did not provide the ¼" gap required for the sliding mechanism. After filing material on the side pieces of level 1 and level 3 to restore the ¼" gap, the sliding mechanism again worked properly. The frame is illustrated in See FIGS. 5-9.

Frame Fabrication and Assembly

Figure 10:
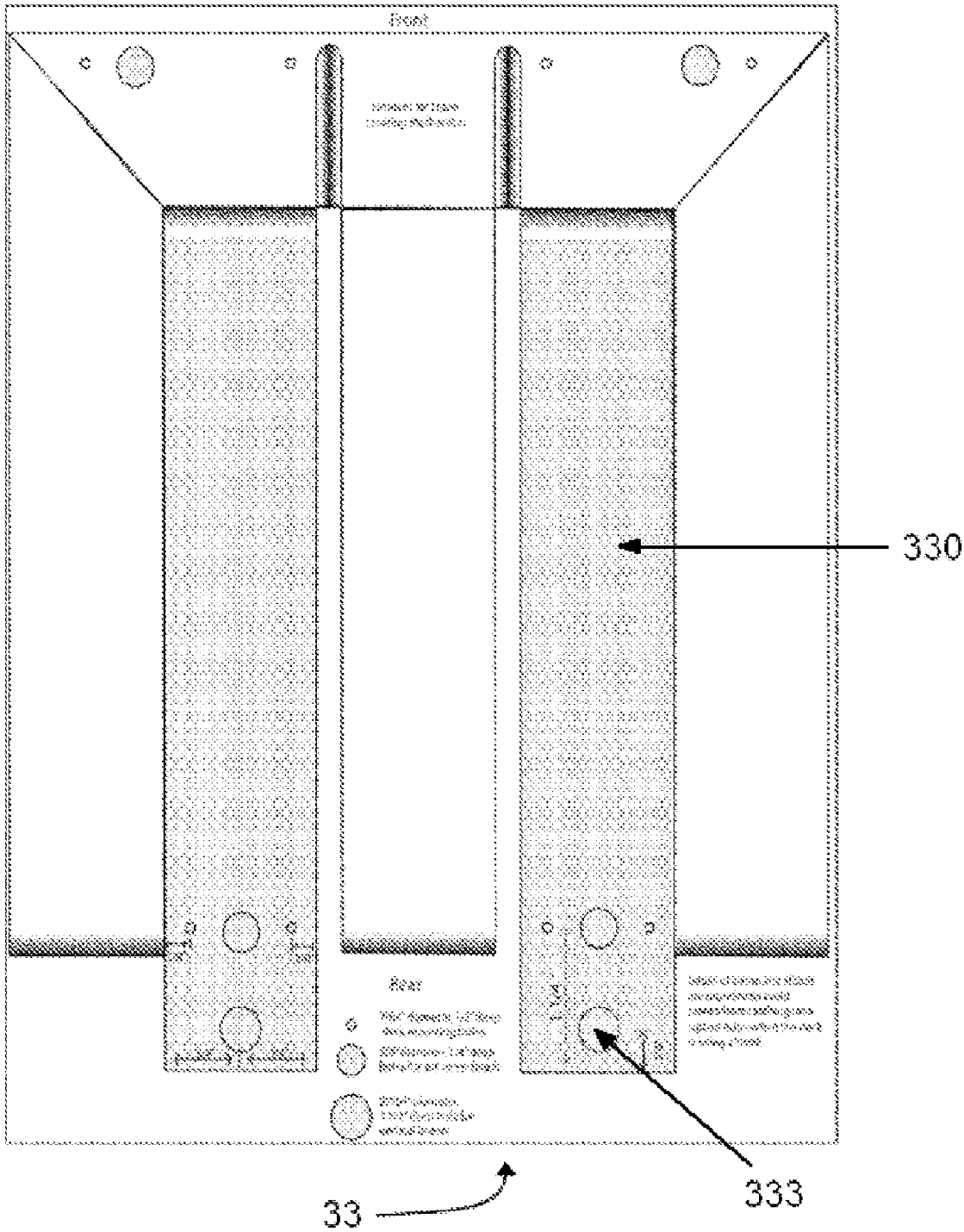
FIG. 10 is a top-view of Frame Sliders in accordance with the present invention.
Figure 11:
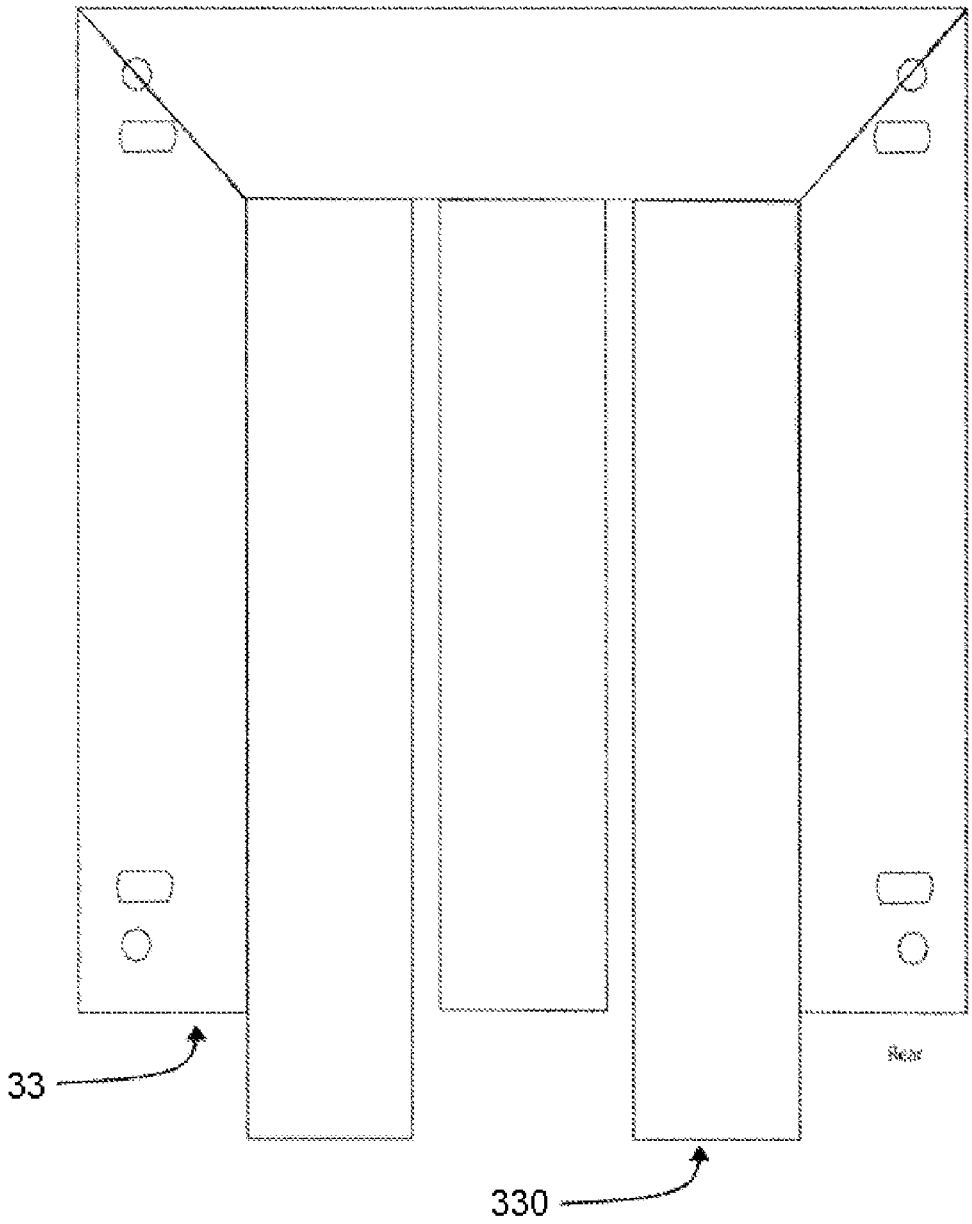
FIG. 11 is a view of Frame—Level #1 with Mounting Holes in accordance with the present invention.

These instructions apply to fabrication in wood, such as was used in the fabrication of the prototype. Cut the oak and pine to the dimensions shown in FIGS. 5-7. Glue the front and sides of level 1 together. Repeat the process for level 3. When gluing the miter joints for levels 1 and 3, a right angle clamp should be used to insure proper alignment. Glue level 2 to level 1. Do not glue level 3 to the frame at this time. Cut or chisel the grooves in the top of level 3 required for the slider limiting mechanism on the deck as shown in FIG. 10, which shows frame 33 and sliders 330 with slider holes 333 through which adjustable vertical brace legs 310 pass. Drill two ⅜" diameter holes ¼" deep on the top of level 3 to accommodate the set screws for the alignment pins on the bottom of the deck as shown in FIG. 10.

Center Support

Figure 12:
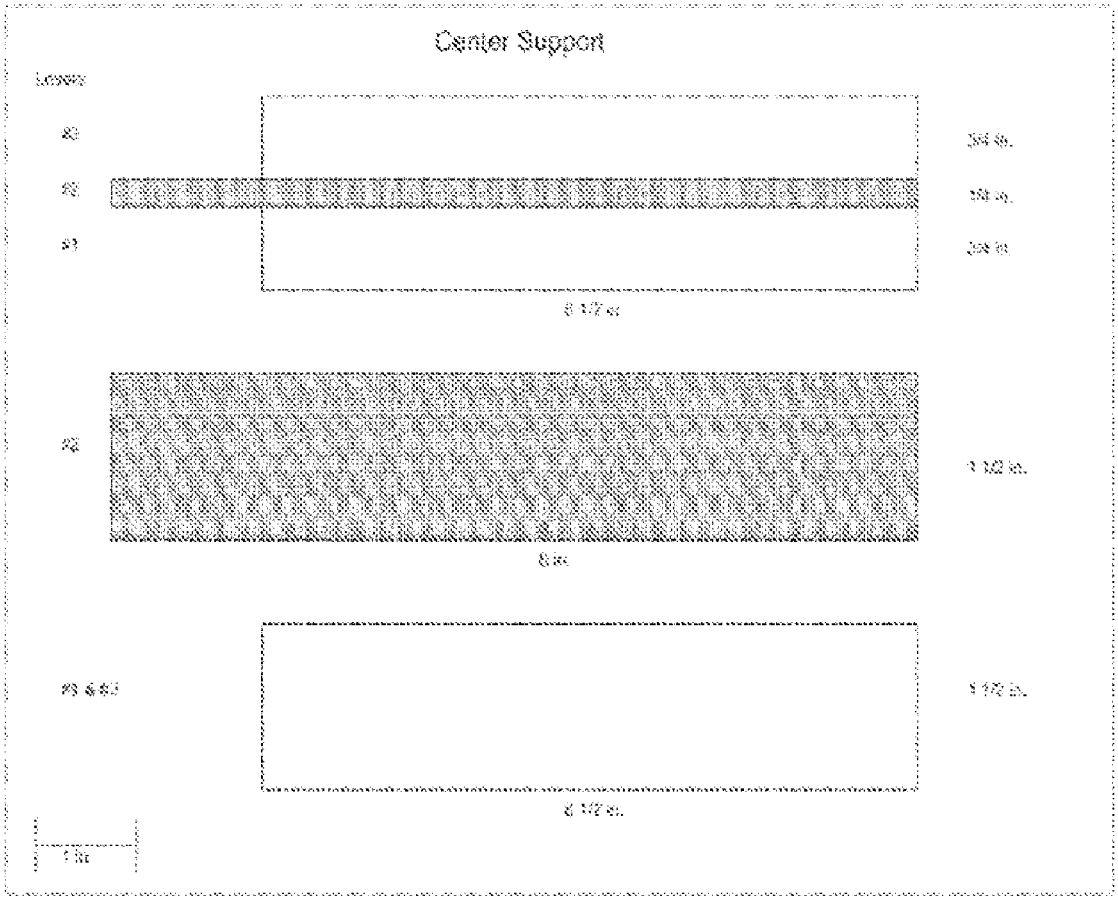
FIG. 12 is a view of a Center Support—Levels #1, #2 & #3 in accordance with the present invention.

The center support 36 can be made of wood, metal, plastic, ceramic, engineered composites or any other material that offers the properties required for this function. The prototype's center support used 1½"×¾" oak and 1½"×¼" pine. The three levels of the center support match the three levels in the frame. Therefore if ⅜" material is used for layer in the frame, it must also be used in the center support. The center support in the prototype consists of three levels as shown in FIG. 12. If the step is made out of other materials, several or all of these levels may be combined. The bottom layer is level 1, the middle layer is level 2 and the top layer is level 3. The pieces for level 1 and 3 were made of oak while level 2 was made of pine. See FIG. 12.

Center Support Fabrication and Assembly

These instructions apply to fabrication in wood, such as was used in the fabrication of the prototype. Cut the oak and pine to the dimensions shown in FIG. 12. Glue levels 1, 2 and 3 together. Care should be used to align the layers as closely as possible.

Sliders

The sliders 330 can be made of wood, metal, plastic, ceramic, engineered composites or any other material that offers the properties required for this function.

Slider Materials

The prototype's sliders used 1½"×¾" oak and 1½"×¼" pine. The three levels of the slider match the three levels in the frame. The three levels of the slider match the three levels in the frame. Therefore if ⅜" material is used for layer 2 in the frame, it must also be used in the sliders. Each slider also has two 3½"×¼" carriage bolts two washers and one ¼" nut and one ¼" wing nut.

The sliders in the prototype consist of three levels. If the step is made out of other materials, several or all of these levels may be combined. The bottom layer is level 1, the middle layer is level 2 and the top layer is level 3. The pieces for level 1 and 3 were made of oak while level 2 was made of pine. See FIGS. 13 & 14

Slider Fabrication and Assembly

Figure 13:
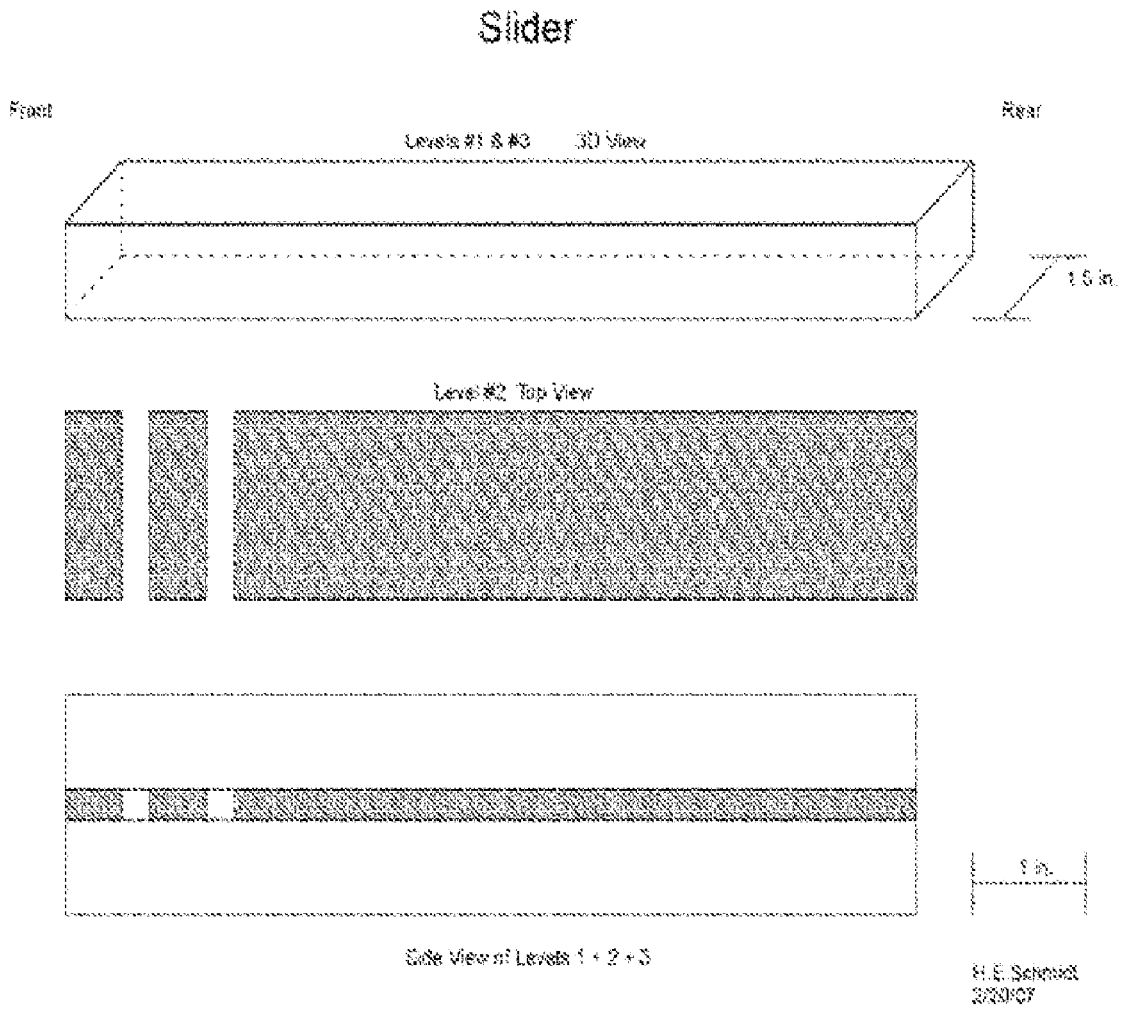
FIG. 13 is a view of Slider—Levels #1, #2 & #3 in accordance with the present invention.
Figure 14:
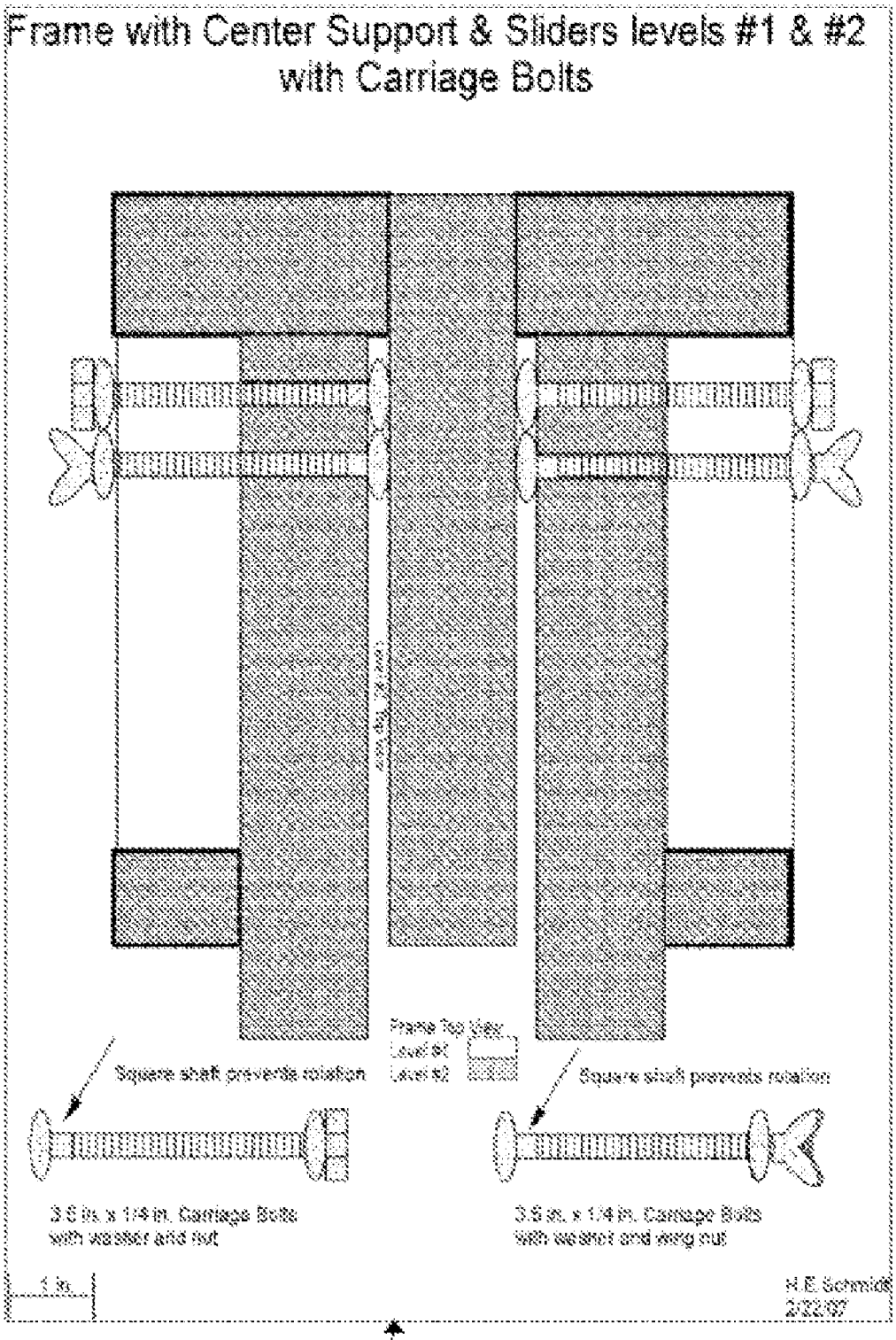
FIG. 14 is a view of a Frame with Center Support & Sliders with Carriage Bolts in accordance with the present invention.

These instructions apply to fabrication in wood, such as was used in the fabrication of the prototype. Cut the oak and pine to the dimensions shown in FIG. 13. Cut the oak and pine to the dimensions shown in FIG. 13. Glue levels 1, 2 and 3 together. Care should be used to align the layers as closely as possible. Insert the carriage bolts into the square openings in the sliders as shown in FIG. 13. Place the flat washers on the carriage bolts so that the smooth side faces the slider and attach the nut and wing nut as shown in FIG. 14. Drill a ⅜" diameter hole ¼" deep on the top of each slider to accommodate the set screws for the alignment pins on the bottom of the deck as shown in FIG. 10. Drill a 27/64" diameter hole 1½" deep on the top of each slider to accommodate the adjustable vertical brace. See FIG. 10.

Figure 15:
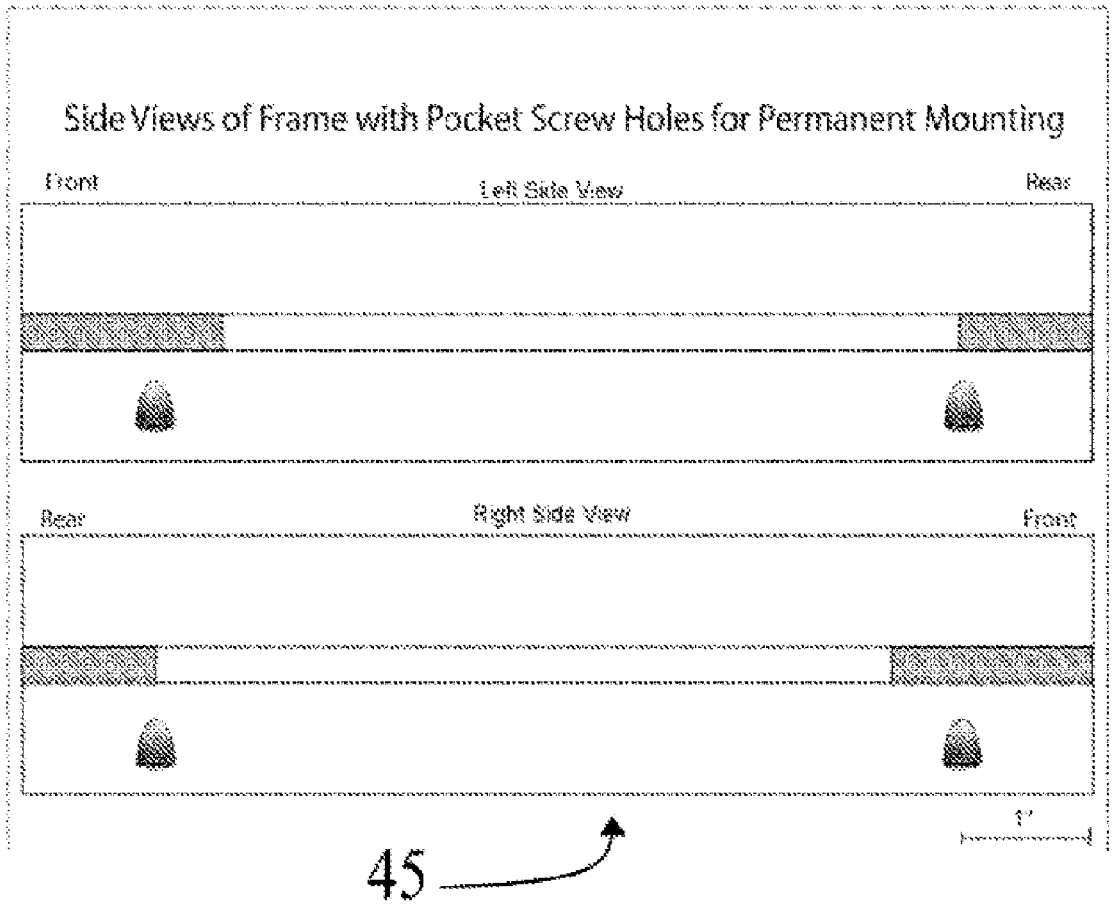
FIG. 15 is a side-view of a Frame with Pocket Screw Holes for Permanent Mounting in accordance with the present invention.

After the sliders 330 are complete, place them in the frame as shown in FIG. 10. Then glue level 3 of the frame in place. Drill pocket screw holes in the sides of the frame as shown in FIG. 15.

Base

The base can be made of wood, metal, plastic, ceramic, engineered composites or any other material that offers the properties required for this function.

Base Materials

The base 50 in the prototype was made from ½" plywood with a smooth veneer on both sides. To reduce weight and materials cost, it may be desirable to create a mesh, waffle or honey comb or any other design that still meets the structural requirements for The Step.

Base Fabrication and Assembly

Figure 16:
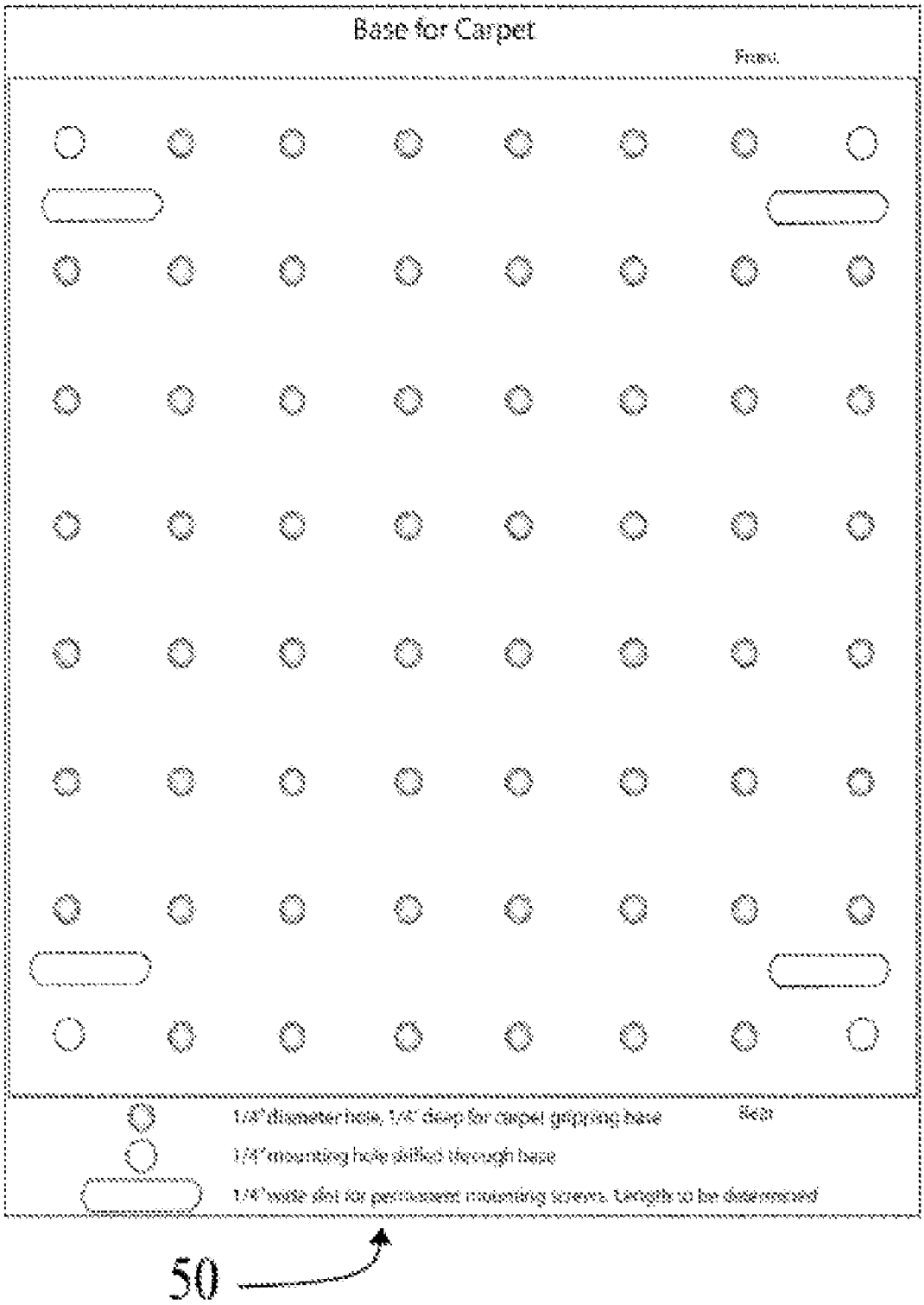
FIG. 16 is a view of a Base with Holes for Carpet Gripping Plate in accordance with the present invention.

The main base 50 in the prototype is an 8"×8" plywood square. One surface of the base has a matrix of ¼" diameter holes drilled ¼" deep to match the pattern of the points on the gripping plate. See FIG. 16.

Figure 17A:
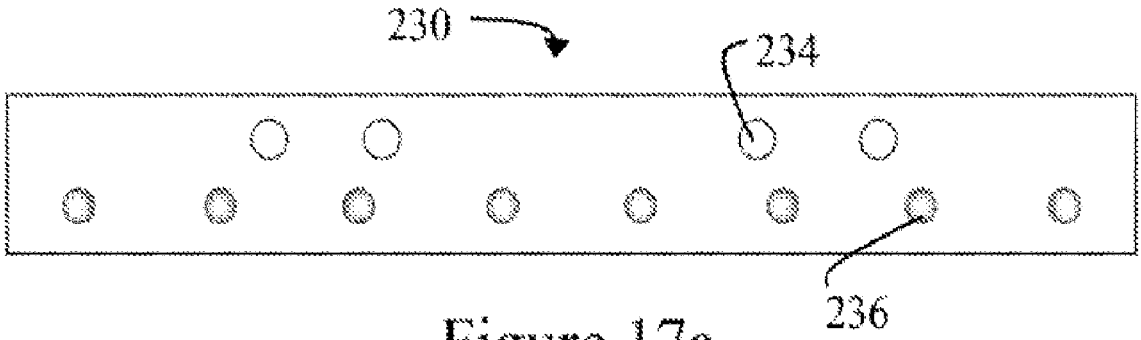
FIG. 17*a* is a view of a Slider base in accordance with the present invention.
Figure 17B:
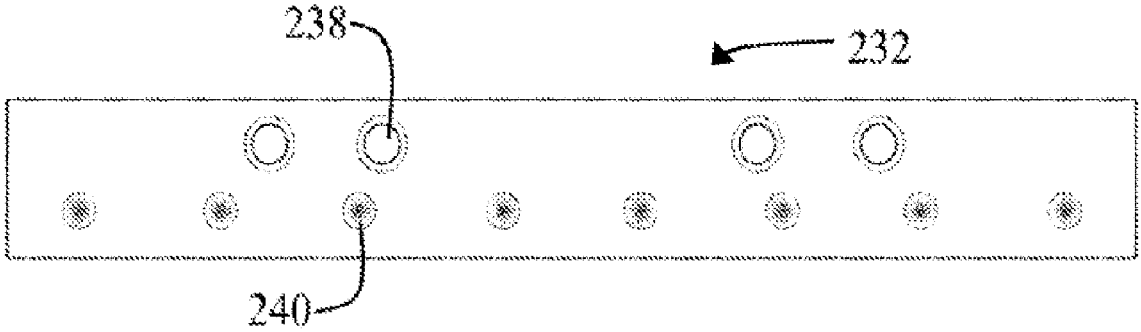
FIG. 17*b* is a view of a Slider Gripping Plate in accordance with the present invention.
Figure 18:
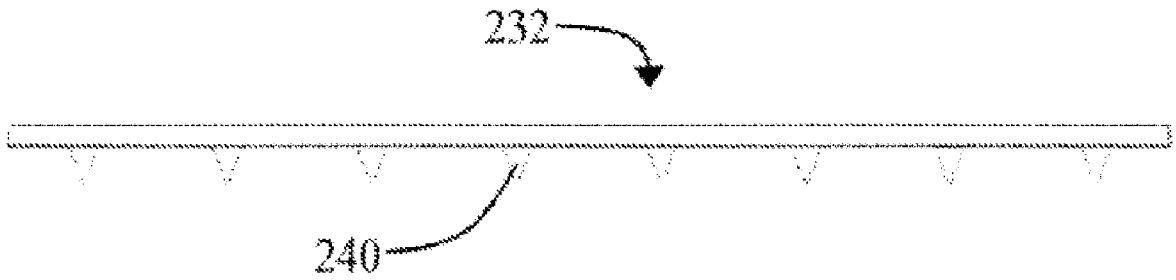
FIG. 18 is a view of a Gripper Plate—Side View in accordance with the present invention.

The slider base 230 in the prototype is an 1"×8" plywood rectangle. One surface of the base has a series of ¼" diameter holes drilled ¼" deep to match the pattern of the points on the gripping plate 232. See FIGS. 17*a* and 17*b*. Shown are mounting holes to mount base to slider 234 and holes to receive gripper plate bumps when used on hard floors 236. Also show are counter sink holes on smooth side of gripper plate 238 and carpet gripping bumps 240. Shown is FIG. 18 is a side view of gripper plate 238.

Gripper Plate

Figure 19:
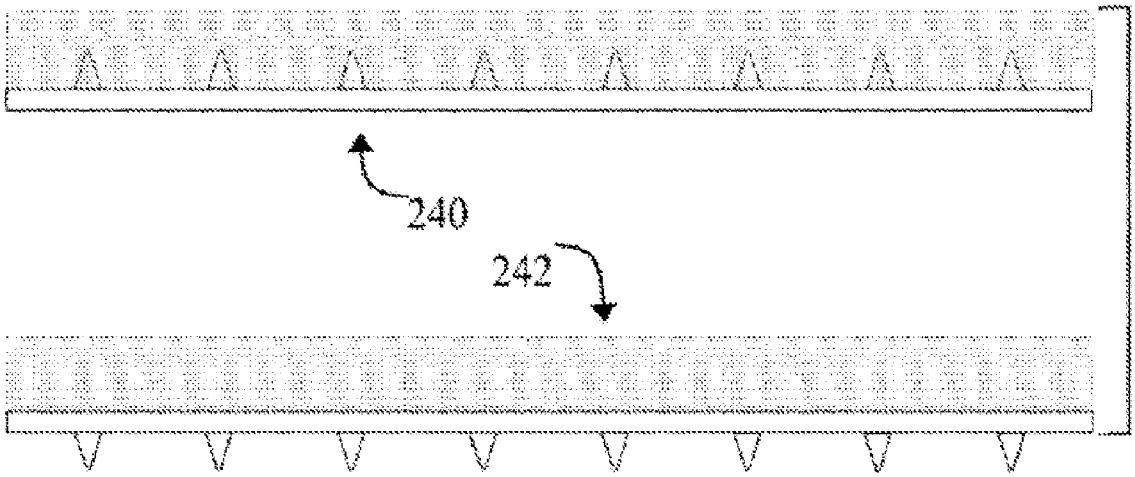
FIG. 19 is a view of a Base and Gripping Plate Configurations in accordance with the present invention.
Figure 20:
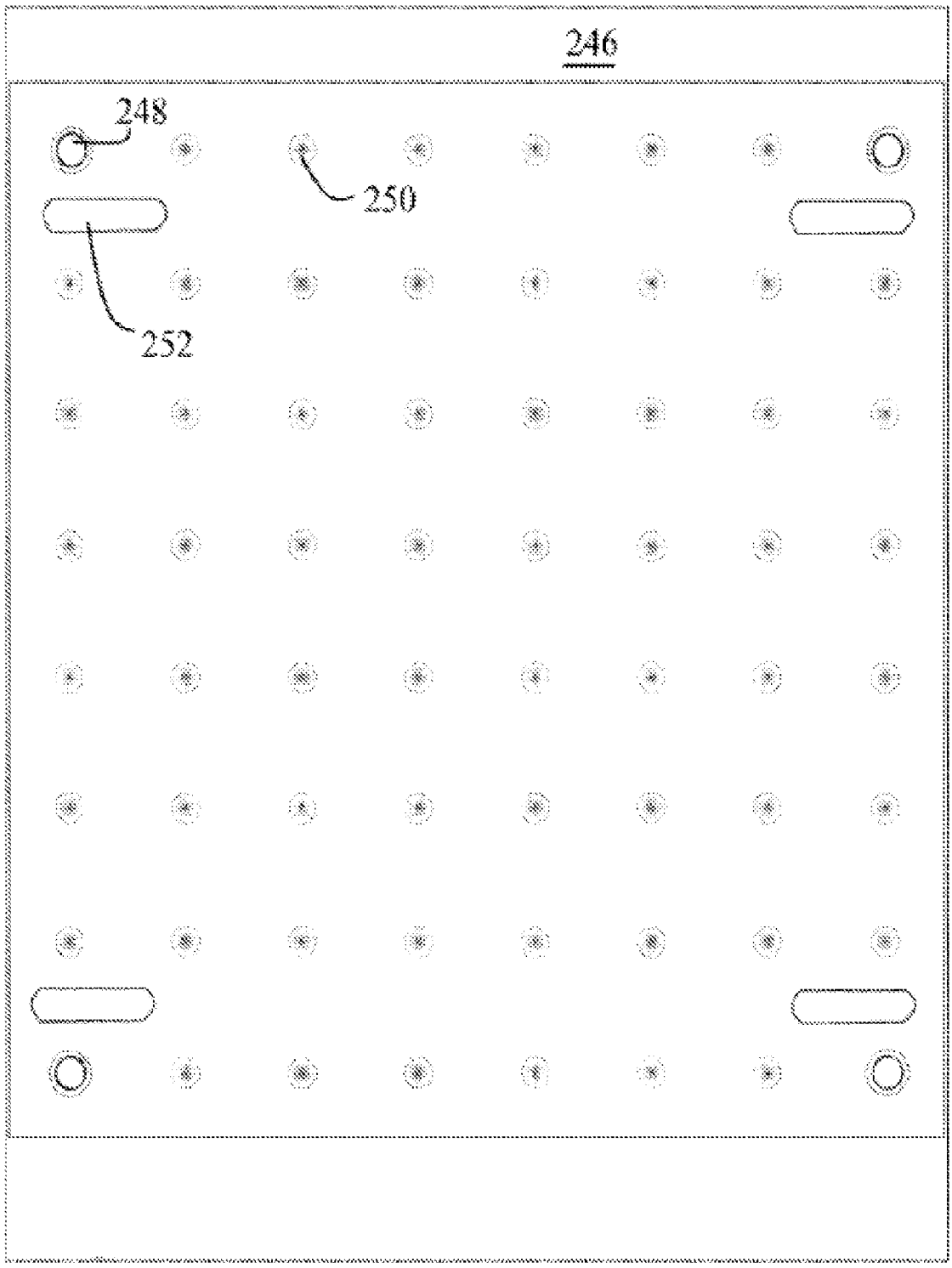
FIG. 20 is a view of a Gripper Plate for Carpet in accordance with the present invention.

The gripper can be made of wood, metal, plastic, ceramic, engineered composites or any other material that offers the properties required for this function. Shown in FIG. 19 is base and gripping plate configurations with wood floor configuration 240 and pointed carpet gripping bumps 250. Shown in FIG. 20 is gripper plate for carpet 246 pointed carpet griping bumps 248, mounting hole drilled through base counter sunk for mounting screw head 250 and wide slot for permanent mounting screws 252.

Gripper Plate Materials

The base in the prototype was made from a plastic office chair mat. One side is smooth and the other side has pointed plastic bumps that grip the carpet. See FIGS. 17*b* & 18-20.

Interface for Non-Carpeted Stairs

Examples of materials that can be used to secure The Step to uncarpeted stairs are, but are not limited to: double sided tape or solid adhesive material either naturally occurring or man made Velcro anti-skid material or suction cups glue, caulk or other adhesive either naturally occurring or man made Some examples of double sided solid adhesive materials that may be used are, but are not limited to:

Command Removable Mounting strips by 3M, St. Paul, Minn.

Polyken 100D Premium Double Coated Carpet Tape (Covalence Adhesives, Franklin, Mass.).quadrature.JVCC DCC-2R Premium Double Coated Carpet Tape (JVCC., Inc., Fairless Hills, Pa.)

Adjustable Vertical Brace

Figure 21:
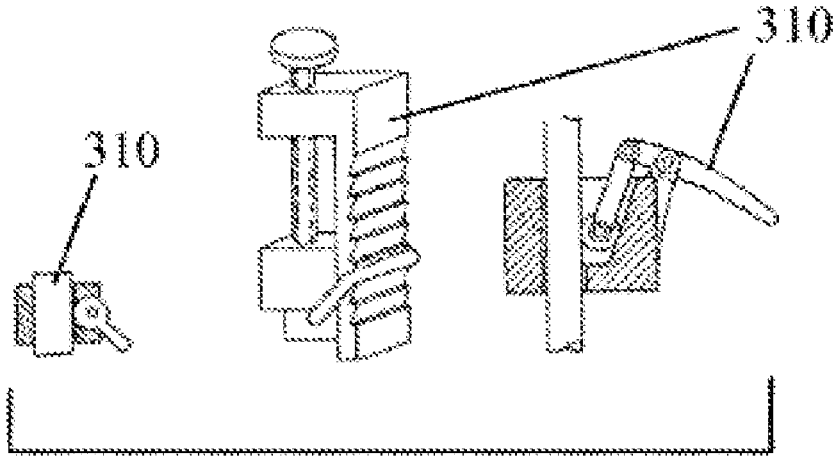
FIG. 21 is a view of Examples of Adjustable Vertical Support Brace Mechanisms in accordance with the present invention.
Figure 22:
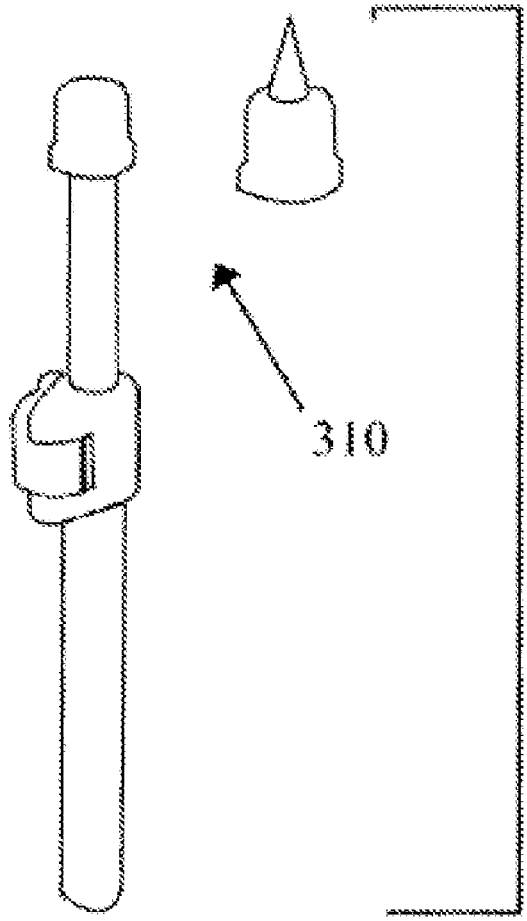
FIG. 22 is a view of a Tripod Adjustable Vertical Brace with Optional Pointed Top in accordance with the present invention.
Figure 30:
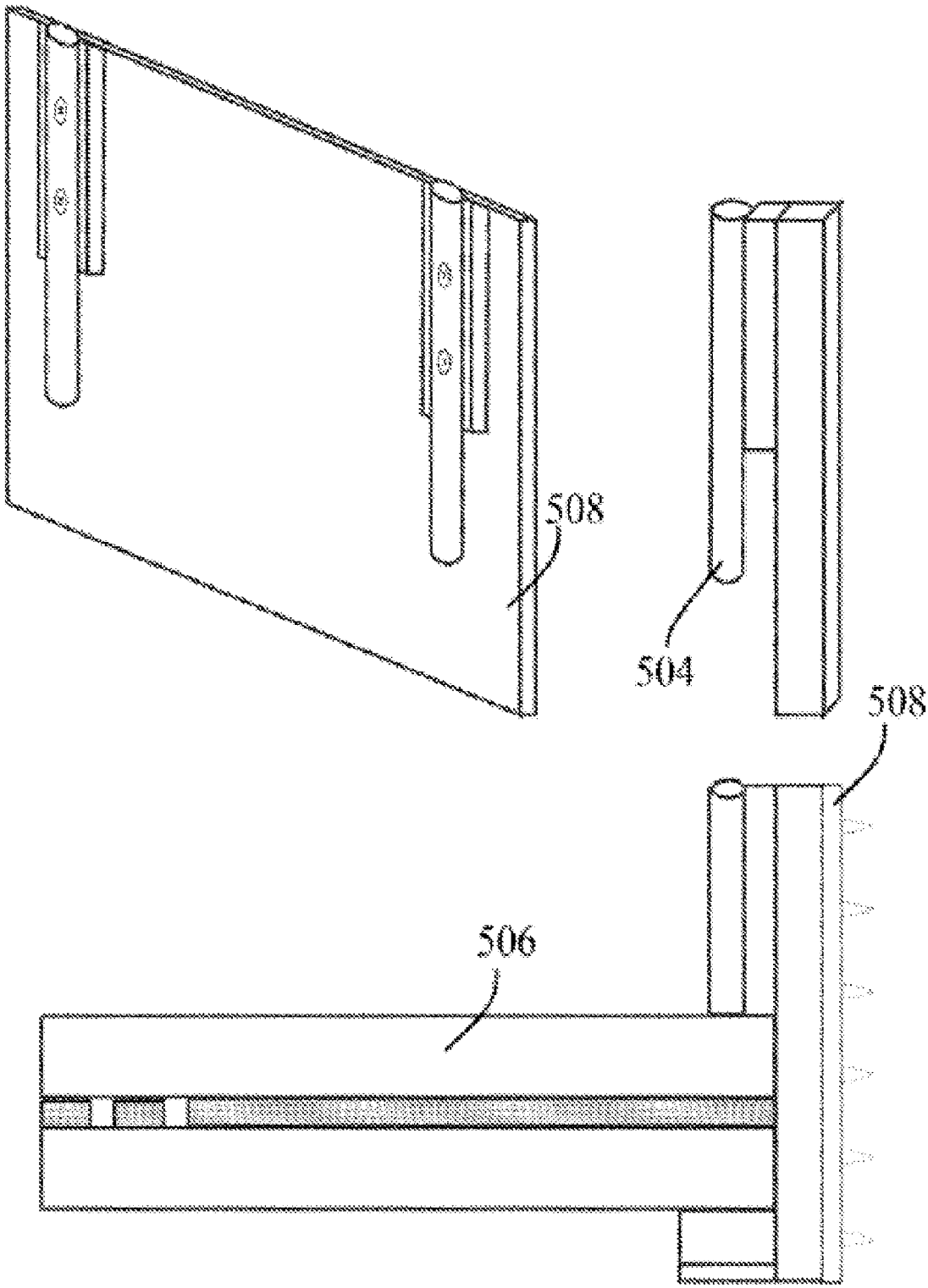
FIG. 30 is a view of a Back Gripper Plate Variation in accordance with the present invention.

The adjustable vertical brace 310 can be of any design that allows quick and easy extension of the member that is able to withstand the forces that can be generated by someone stepping on the edge of the step. A table leveling screw device of sufficient length can also be used for this purpose. Many other established quick-acting clamp designs 310 may be used as well. See FIGS. 21 and 22. The adjustable vertical brace 310 is an embodiment portion that can serve as a substitute embodiment for the combination of cylindrical members 504 and back gripping plate spacer 505 shown as part of back gripping plate 508 in FIG. 30.

Reference: Mechanism and Mechanical Devices, Neil Sclater and Nicholas P. Chironis, McGraw-Hill .COPYRGT.2007 pages 242-243 The top of the brace can be of any non-skid material, or of a metal spike design. The spike could be part of the brace as in some tripod designs. Or, the spike can be an addition to the top of the brace that is installed as desired. The spike could be attached to an end cap that fits securely over the top of the brace. See FIG. 22.

The adjustable vertical brace 310 that was used in the prototype utilizes a vertical brace leg that was taken from a small photographic tripod. See FIG. 22.

Adjustable Vertical Brace Materials

The prototype used portions of a Merkury Innovations photographic tripod model MITR42A (www.merkuryinnovations.com).

Adjustable Vertical Brace Fabrication and Assembly

Two legs of the tripod may be cut to an appropriate length, measured when the smallest section was fully retracted into the next section. The cut was made with a Dremmel tool using a cut-off wheel. Care must be taken not to damage the pieces so they are still able to slide. See FIG. 22.

Adjustable Height Assembly

The height can be adjusted to within any specified tolerance. One reference (http://experts.about.com/e/s/stllstairway.html) indicates that: "Building codes may specify variances [in step height] as small as 0.25 inches (6.4 mm). Therefore, adjustment plates in multiples of ¼" were chosen. Other methods for adjusting the height of The Step are possible, however, they may not be economical to manufacture. One such method is any mechanical system that varies in height, like a scissor jack, screw jack or lab jack.

Adjustment Plate Materials

Figure 23:
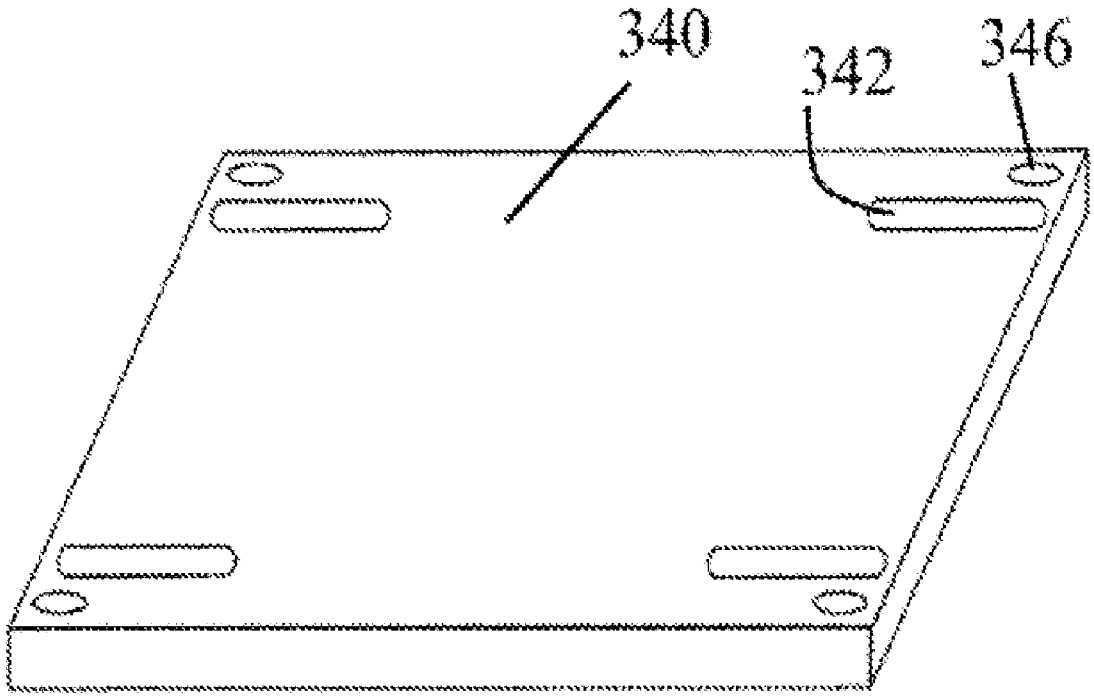
FIG. 23 is a view of an Adjustment Plate in accordance with the present invention.
Figure 26:
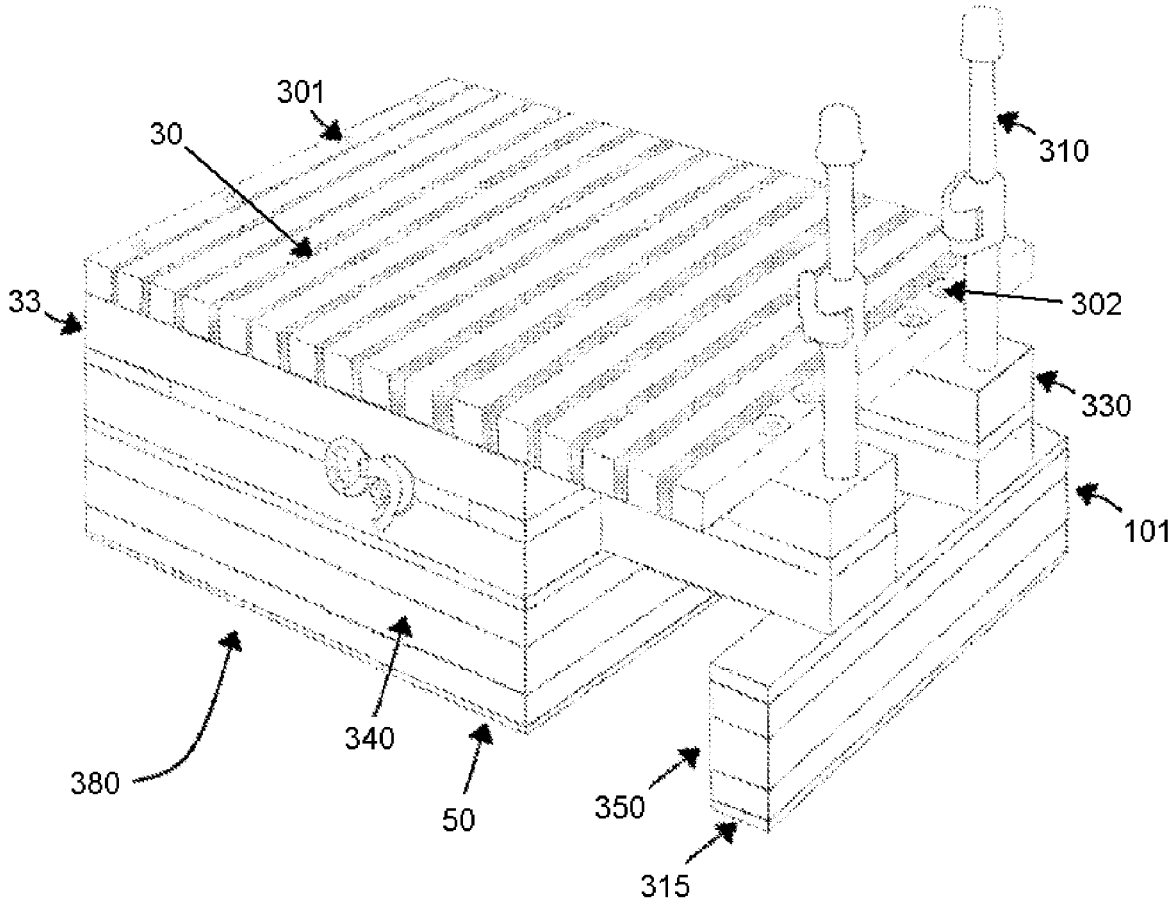
FIG. 26 is a view of a Drawing of The Step with Adjustment Layers in accordance with the present invention and is a complete embodiment except for a back gripper plate assembly that is not attached.

The adjustment plates 340 in the prototype 380 of FIG. 26 were made from ¼", ½" and ¾" plywood with a smooth veneer on both sides and are shown below frame 33 and above base 50 in prototype 380. In this prototype deck 30 is shown attached to front of frame 33 at attachment points 301 and to the rear of slider 330 at second attachment points 302. Slider adjustment plate assembly 101 is shown with its base 315 and its adjustment layers 350 contacting slider 330 and having adjustable vertical brace 310 protruding into slider 330, which is shown resting upon adjustment layers 350. Shown in FIG. 23 are mounting holes 346 and wide grooves 342 of adjustment plates 340. See FIGS. 23 & 24. To reduce weight and materials cost, it may be desirable to create a mesh, waffle or honey comb or any other design that still meets the structural requirements for The Step.

Base Adjustment Plate and Assembly

Figure 24:
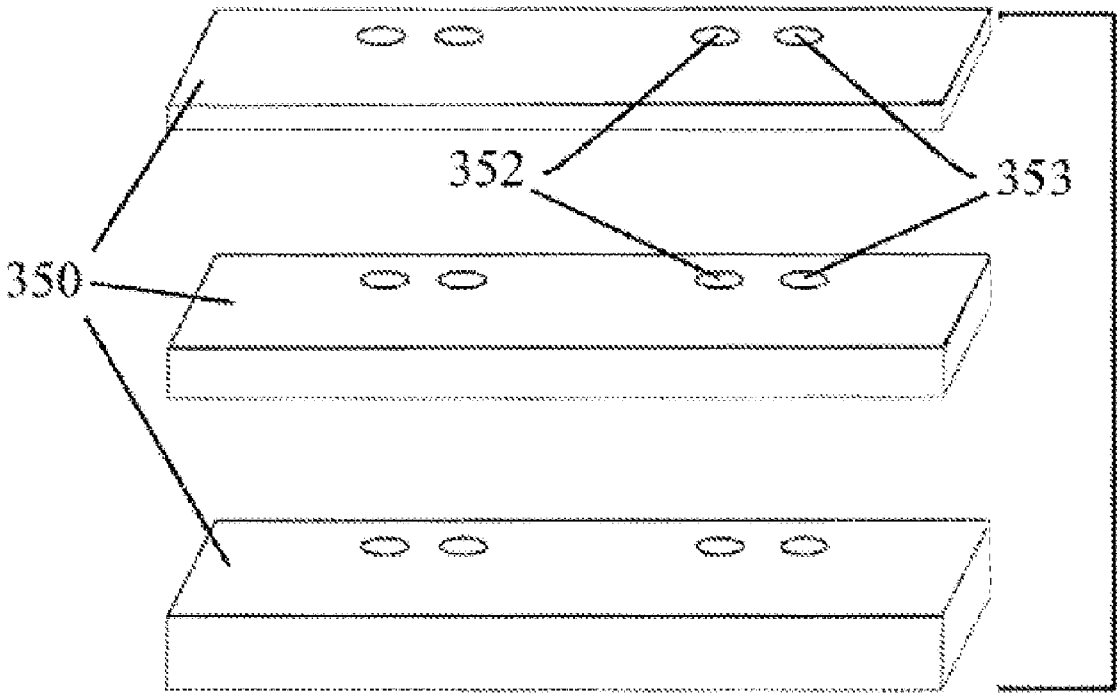
FIG. 24 is a view of a Slider Adjustment Plates in accordance with the present invention.

The adjustment plates are 8"×8" plywood squares. Mounting holes are drilled in the corners of the plates and grooves of appropriate length are made to accommodate permanent attachment of The Step with wood screws. See FIG. 23 Slider Adjustment Plate and Assembly The slider adjustment plate assembly 101 shown in FIG. 26 includes slider adjustment plates 350 that may be 1"×8" plywood rectangles. Mounting holes 352 and 353 are drilled in slider adjustment plates 350 as shown in FIG. 24 to accommodate permanent attachment to the sliders with wood screws. The adjustable vertical brace legs 310 slide through slider holes 333 (see FIG. 10) and provide an attachment and locking mechanism for attaching prototype 380 to a back gripping plate 508 that is secured or otherwise anchored to the stair riser to hold The Step in place (See FIG. 30). Thicknesses of slider adjustment plates 350 and adjustable vertical base 315 (See FIG. 26) may correspond to thicknesses of adjustment plates 340 and its base 50 and collectively provide support for slider 330.

Figure 25:
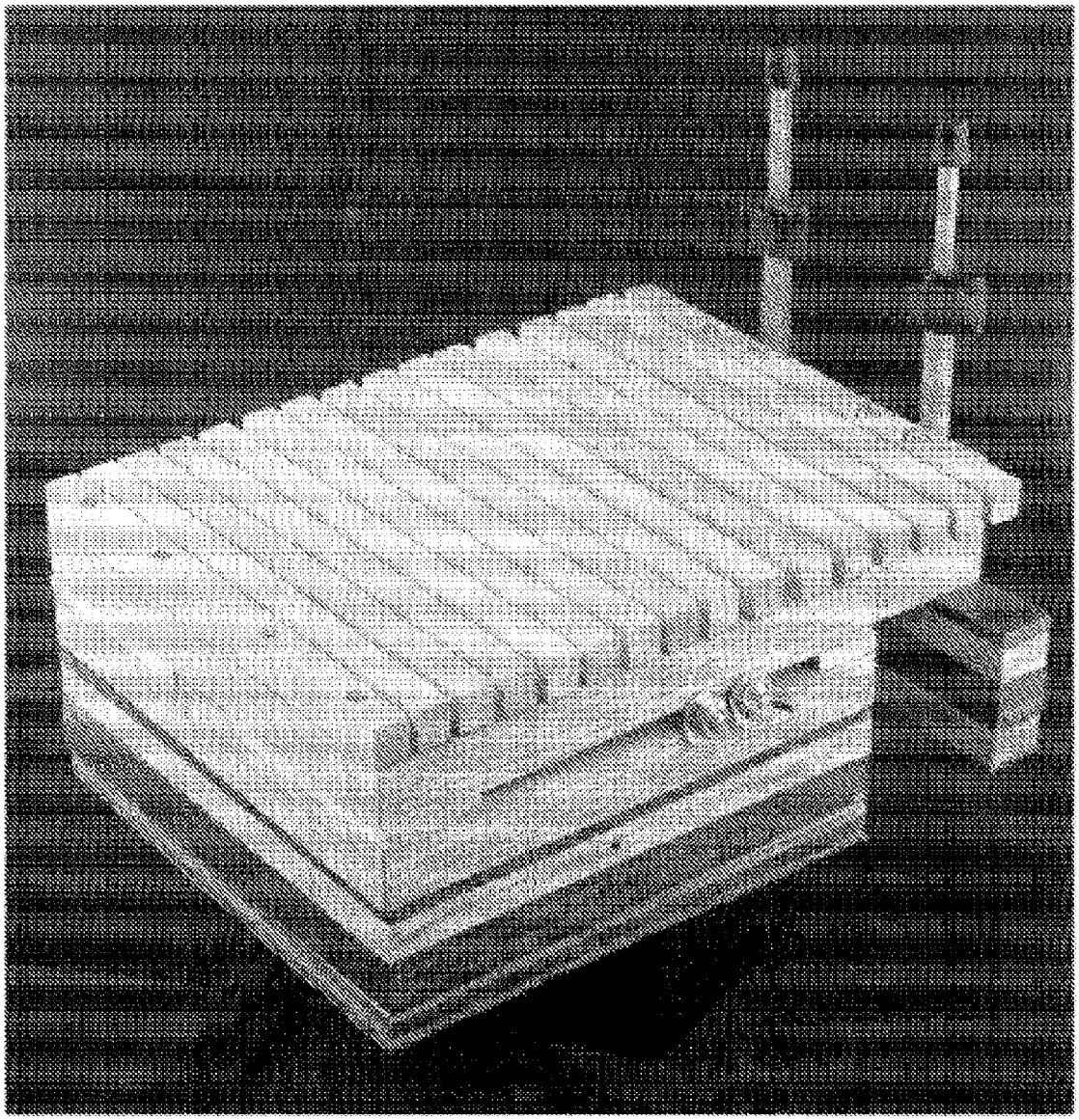
FIG. 25 is a view of a Photo of Fully Operational Prototype in accordance with the present invention without a back gripper plate attached.

A photograph of the prototype 370 with three adjustment layers (¼", ½" and ¾") and the tripod adjustable vertical braces is shown in FIG. 25. A drawing of The Step 380, viewed from a different angle, is shown in FIG. 26.

Surface Covering

A variety of surface coverings are available. The vinyl material I selected for the prototype is StepGuard (by Multy Industries Flexible Products Group, Inc., Toronto, Canada). HOLD-IT anti-skid material is used (Henkel Consumer Adhesives, Avon Ohio).

Examples of materials that can be used to secure the surface covering to the deck are, but are not limited to: double sided tape or solid adhesive material either naturally occurring or man made anti-skid material or other adhesives either naturally occurring or man made Some examples of double sided solid adhesive materials that may be used are, but are not limited to: Command Removable Mounting strips by 3M, St. Paul, Minn. Polyken 100D Premium Double Coated Carpet Tape (Covalence Adhesives, Franklin, Mass.) JVCC DCC-2R Premium Double Coated Carpet Tape (JVCC., Inc., Fairless Hills, Pa.) HOLD-IT for Rugs is an example of an anti-skid material (Henkel Consumer Adhesives, Avon Ohio).

Variations to the Step

Carpet Runner Variation

Figure 27:
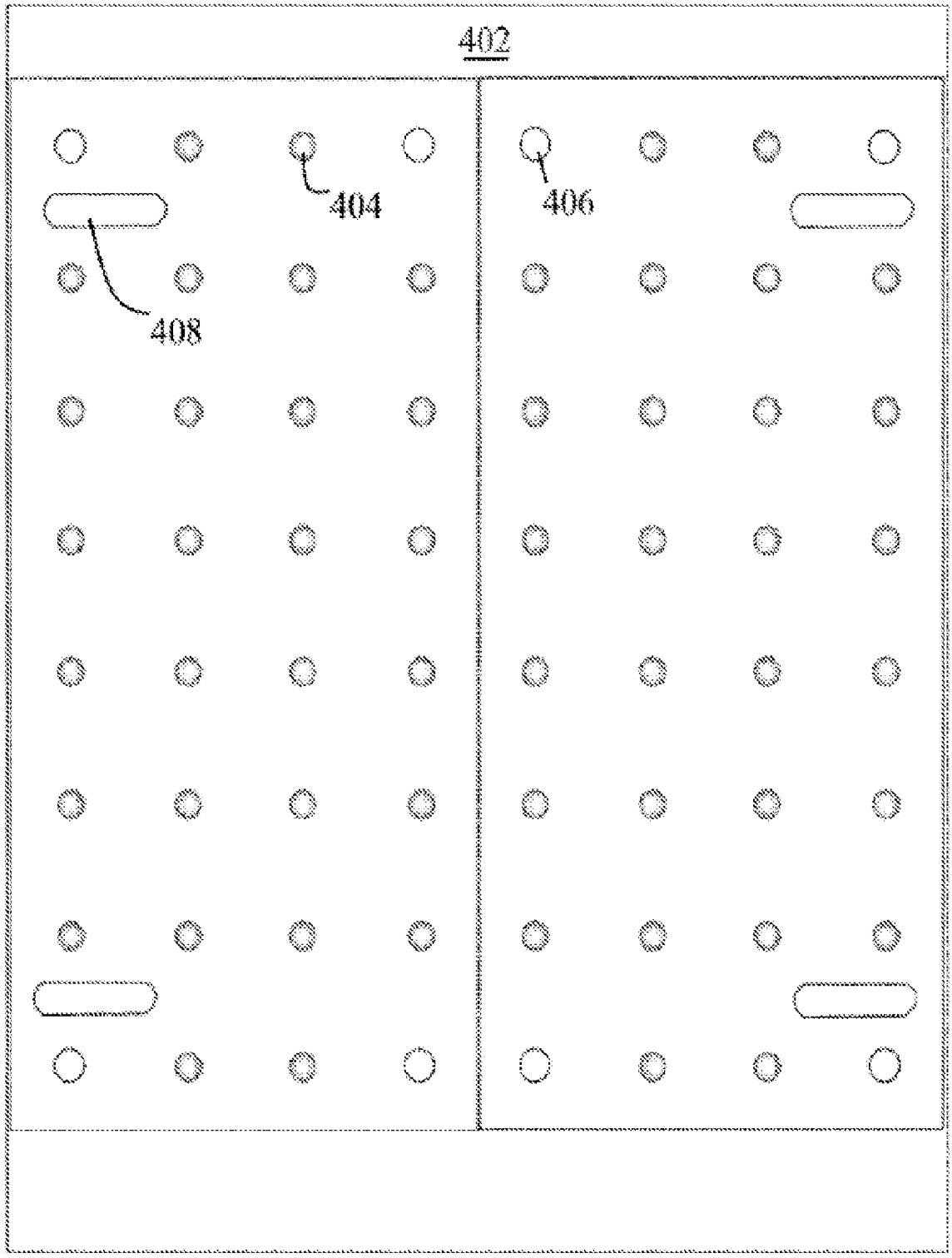
FIG. 27 is a view of a Base for Carpet Runner Variation in accordance with the present invention.
Figure 28:
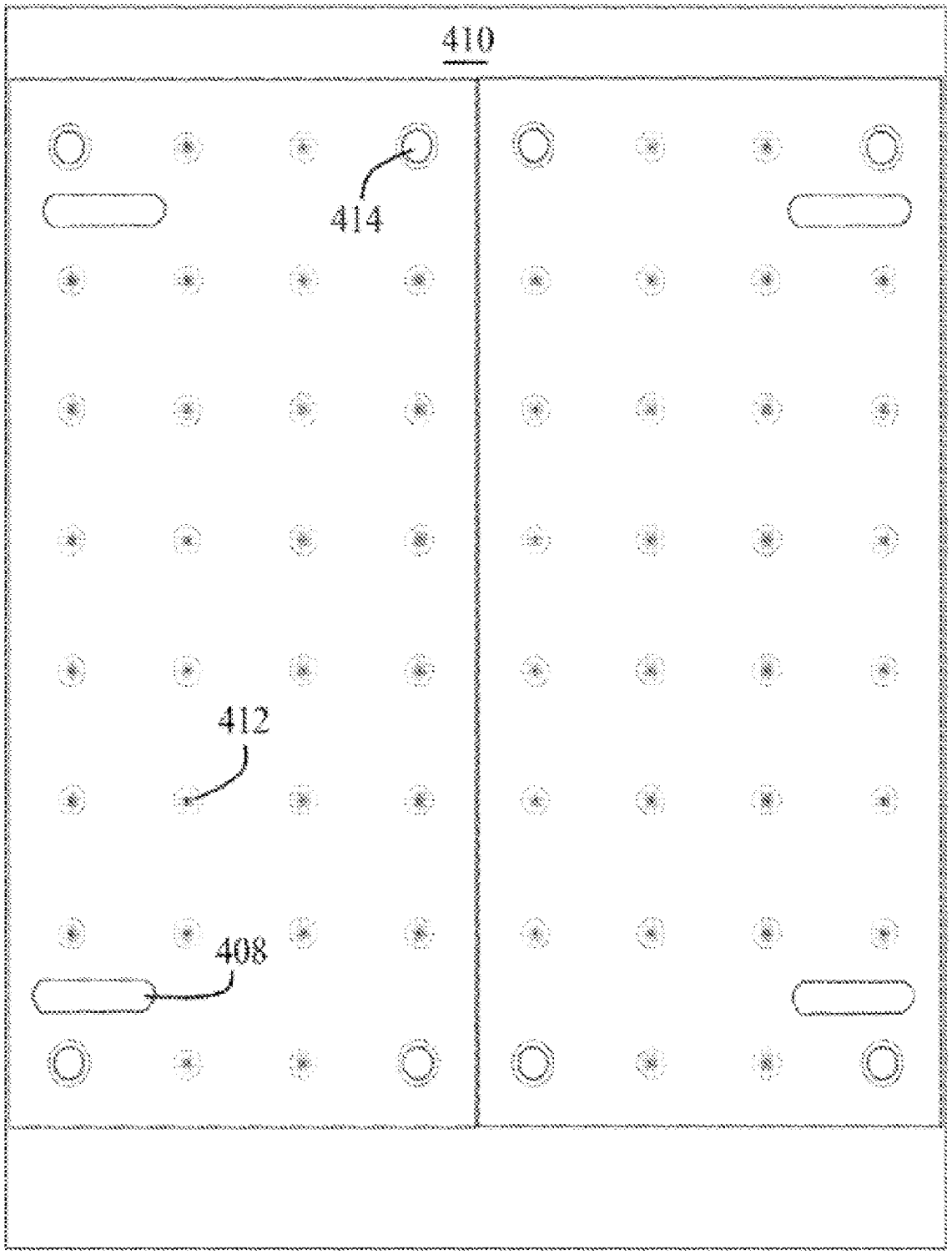
FIG. 28 is a view of a Gripper Plate for Carpet Runner Variation in accordance with the present invention.
Figure 29A:
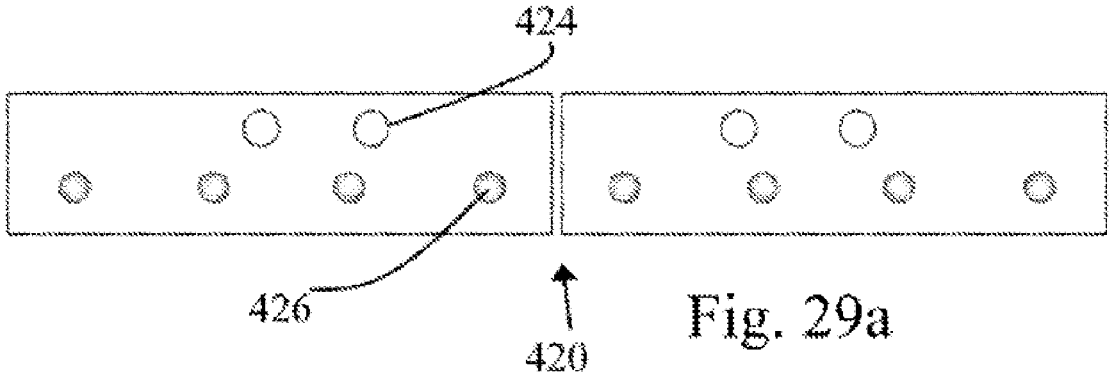
FIG. 29*a* is a view of a Half Width Slider Base for Carpet Runner Variation in accordance with the present invention.
Figure 29B:
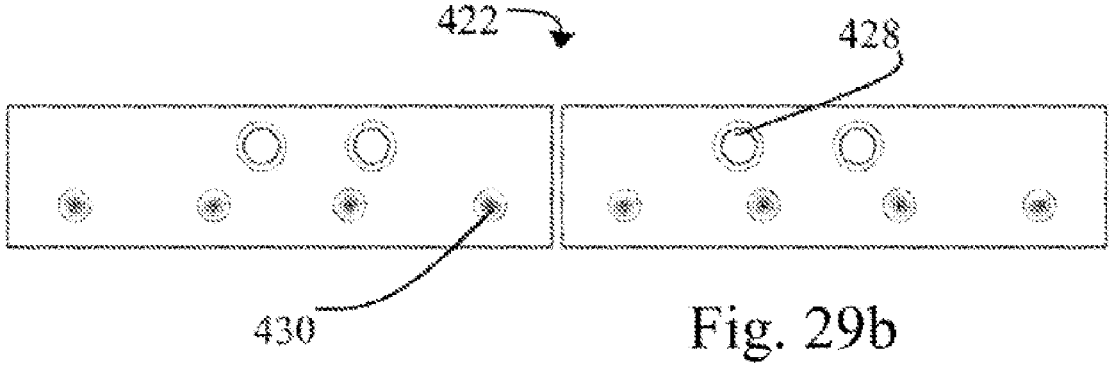
FIG. 29*b* is a view of a Half Width Slider Gripper Plate for Carpet Runner Variation in accordance with the present invention.

Variations to The Step can accommodate installation on stairs with a carpet runner on the center part of the stairs. This is accomplished by using a split base plate and split gripper plates. See FIGS. 27-29. Shown are base for carpet runner option 402 with holes for carpet gripping base 404, through hole in the base 406 and slot for screws 408. Shown is FIG. 28 are gripper plates for carpet runner options 410 with hole for carpet gripping bumps 412, through hole in the base counter sunk 414 and slot for screws 408. Shown in FIG. 29 is a carpet runner variation with a half width slider base 420 and half width slider gripper plate 422. The half width slider base 420 has mounting holes to mount base to slider 424 and holes to receive gripper plate bumps when used on hard floors 426. The half width slider gripper plate 422 has counter sunk holes on smooth side of gripper plate 428 and carpet gripping bumps 430.

No Overhang Variations

Variations to The Step can accommodate special situations where there is no overhanging step for the adjustable vertical brace to use to stabilize The Step, and the use of permanent mounting screws is infeasible or undesirable.

Back Gripping Plate Variation

If the stairs are carpeted, another carpet gripping plate can be used on the back of the sliders (330 in FIGS. 10 and 506 in FIG. 30), or a gripping plate can be attached to the stair riser. This "back gripping plate" 508 should be as large as possible to provide as much surface contact as possible to the stair riser, particularly when a stair is carpeted. When a stair riser is covered with carpet back gripping plate 508 can be comprised of a solid portion 507 and a back base layer 509 that is configured to grip the carpet. It 508 can be screwed into the back of the sliders 506 or it can have cylindrical members 504 that are inserted into the adjustable vertical brace holes 333 (shown in FIG. 10) of sliders 506 and attached through back gripping plate spacer 505 to the back gripping plate 508. When the back gripping plate is secured to the riser on the stairs, The Step will be stabilized. See FIG. 30.

This plate will engage the carpet securely to provide additional stability against tipping. Velcro or other adhesive materials may also be used if they can be determined to provide adequate stability. If the stairs are not carpeted, then the large back gripping plate can be flipped over in the same manner as shown for the base plate in FIGS. 16, 19 and 20. The smooth surface can then be used with double-sided tape, Velcro or other adhesive materials.

This approach can be adapted to any surface with appropriate adhesives to secure The Step to the existing stairs. This includes, but is not limited to:

Concrete
Brick
Tile
Terrazzo
Marble

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. An adjustable stepping platform used on a stairway for ease of descending and ascending, the platform comprising:

an adjustable upper surface, a slider mechanism including a frame portion and a slider portion, wherein the slider portion is selectively guided relative to the frame portion to permit the slider portion to move in a first direction relative to the frame portion, the frame portion is coupled to a first portion of the upper surface, the slider portion is coupled to a second portion of the upper surface, and wherein a dimension of the upper surface is selectively altered by the slider mechanism;

a lower surface positioned below the slider portion;

a height adjustable body portion; and a lower gripper plate removably coupled to the lower surface of the platform, wherein the lower gripper plate includes a first side and an opposing second side, the first side includes a generally planar surface with a plurality of gripping portions extending therefrom, and wherein the gripper plate may be inverted such that either the first side or the second side contact the lower surface of the platform and the other of the first side or the second side contact a first stair tread.

2. The platform of claim 1, wherein the lower surface of the platform includes a plurality of apertures, and wherein at least a portion of the gripping portions of the lower gripper plate selectively extend into the apertures.

3. The platform of claim 1, further comprising a vertical brace for coupling the platform to a second stair tread, wherein the vertical brace is adjustable to bindingly contact the second stair tread.

4. The platform of claim 3, wherein the vertical brace is coupled directly to the slider portion.

5. The platform of claim 1, wherein the upper surface is defined by a plurality of deck portions, at least a portion of the deck portions include at least one alignment aperture.

6. The platform of claim 5, further comprising a covering portion for covering at least a portion of the upper surface.

7. The platform of claim 5, further comprising a travel limiting mechanism for selectively urging a plurality of deck portions to move when at least one of the other deck portions is moved and for providing a maximum spacing between adjacent deck portions.

8. The platform of claim 5, wherein the deck portions include a front deck portion, a rear deck portion, and a plurality of middle deck portions interposed between the front deck portion and the rear deck portion, the front deck portion is one of the first portion and the second portion of the upper surface, the rear portion is the other of the first portion and the second portion of the upper surface, the middle deck portions each include first alignment apertures and second alignment apertures, and wherein the platform includes a first alignment pin coupled to the front deck portion and a second alignment pin coupled to the rear deck portion, wherein the first alignment pin is interposed through a portion of the first alignment apertures and wherein the second alignment pin is interposed through a portion of the second alignment apertures.

9. The platform of claim 8, further comprising a third alignment pin coupled to the front deck portion and a fourth alignment pin coupled to the rear deck portion.

10. The platform of claim 1, further comprising a covering portion for covering the upper surface.

11. The platform of claim 1, further comprising a second slider portion coupled to the second portion of the upper surface and a fastening device for coupling the slider portion to the frame portion to resist relative movement therebetween.

12. The platform of claim 11, wherein the platform includes a center support interposed between the slider portion and the second slider portion.

13. The platform of claim 12, wherein the removable portion is selectively interposed between the lower surface and the slider portion.

14. The platform of claim 12, further comprising a plurality of removable portions.

15. The platform of claim 1, wherein the height adjustable body portion includes at least one removable portion of a predetermined thickness, and wherein the addition of the removable portion will increase the height of the platform by the predetermined thickness.

16. An adjustable platform comprising:

an adjustable upper surface, a slider mechanism including a frame portion and a slider portion, wherein the slider portion is selectively guided relative to the frame portion to permit the slider portion to move in a first direction relative to the frame portion, the frame portion is coupled to a first portion of the upper surface, the slider portion is coupled to a second portion of the upper surface, and wherein a dimension of the upper surface is selectively altered by the slider mechanism;

a lower surface positioned below the slider portion; and a lower gripper plate removably coupled to the lower surface of the platform, wherein the lower gripper plate includes a first side and an opposing second side, the first side includes a generally planar surface with a plurality of gripping portions extending therefrom, and wherein the gripper plate may be inverted such that either the first side or the second side contact the lower surface of the platform and the other of the first side or the second side contact a first stair tread, and wherein the platform is not attached to a railing.

17. The platform of claim 16, wherein the lower surface of the platform includes a plurality of apertures, and wherein at least a portion of the gripping portions of the lower gripper plate selectively extend into the apertures.

18. The platform of claim 16, further comprising a height adjustable body portion, wherein the height adjustable body portion includes at least one removable portion of a predetermined thickness, and wherein the addition of the removable portion will increase the height of the platform by the predetermined thickness.

19. The platform of claim 16, wherein the adjustable upper surface includes a front deck portion, a rear deck portion, and a plurality of middle deck portions interposed between the front deck portion and the rear deck portion, the front deck portion is one of the first portion and the second portion of the upper surface, the rear portion is the other of the first portion and the second portion of the upper surface, the middle deck portions each include first alignment apertures and second alignment apertures, and wherein the platform includes a first alignment pin coupled to the front deck portion and a second alignment pin coupled to the rear deck portion, wherein the first alignment pin is interposed through a portion of the first alignment apertures and wherein the second alignment pin is interposed through a portion of the second alignment apertures.

20. The platform of claim 16, further comprising a vertical brace for coupling the platform to a second stair tread, wherein the vertical brace is adjustable to bindingly contact the second stair tread.

* * * * *

UNITED STATES PATENT AND TRADEMARK OFFICE

CERTIFICATE OF CORRECTION

PATENT NO. : 7,686,138 B2
APPLICATION NO. : 12/106293
DATED : March 30, 2010
INVENTOR(S) : Helene E. Schmidt It is certified that error appears in the above-identified patent and that said Letters Patent is hereby corrected as shown below:

Title page: #76 Inventor: Delete "Helene Schmidt" Should read as -- Helene E. Schmidt --.

Signed and Sealed this
Twenty-fourth Day of May, 2011

David J. Kappos

David J. Kappos
*Director of the United States Patent and Trademark Office*